US009490532B2

(12) United States Patent
Maruyama et al.

(10) Patent No.: US 9,490,532 B2
(45) Date of Patent: Nov. 8, 2016

(54) ANTENNA DEVICE AND ARRAY ANTENNA DEVICE

(71) Applicant: Mitsubishi Electric Corporation, Tokyo (JP)

(72) Inventors: Takashi Maruyama, Tokyo (JP); Toru Takahashi, Tokyo (JP); Akimichi Hirota, Tokyo (JP); Tetsu Owada, Tokyo (JP); Tomohiro Takahashi, Tokyo (JP); Tomohiro Mizuno, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 14/758,762

(22) PCT Filed: Jan. 27, 2014

(86) PCT No.: PCT/JP2014/051679

§ 371 (c)(1),
(2) Date: Jun. 30, 2015

(87) PCT Pub. No.: WO2014/123024

PCT Pub. Date: Aug. 14, 2014

(65) Prior Publication Data

US 2016/0006118 A1 Jan. 7, 2016

(30) Foreign Application Priority Data

Feb. 7, 2013 (JP) ..... 2013-022437

(51) Int. Cl.
*H01Q 1/24* (2006.01)
*H01Q 1/50* (2006.01)
(Continued)

(52) U.S. Cl.
CPC ..... *H01Q 1/50* (2013.01); *H01Q 1/12* (2013.01); *H01Q 5/378* (2015.01); *H01Q 13/02* (2013.01);
(Continued)

(58) Field of Classification Search
CPC ..... H01Q 1/50; H01Q 21/0006; H01Q 1/12; H01Q 15/24; H01Q 5/378; H01Q 13/18; H01Q 21/064; H01Q 21/0081; H01Q 13/06; H01Q 13/02; H01Q 21/02
USPC ..... 343/700 MS, 702, 872, 878
See application file for complete search history.

(56) References Cited

U.S. PATENT DOCUMENTS 5,025,264 A * 6/1991 Stafford ..... H01Q 13/18 343/767
6,114,997 A 9/2000 Lee et al.
(Continued)

FOREIGN PATENT DOCUMENTS

JP H01-251905 A 10/1989
JP H06-237119 A 8/1994
(Continued)

OTHER PUBLICATIONS

International Search Report; PCT/JP2014/051679; Apr. 22, 2014.
(Continued)

*Primary Examiner* — Khai M Nguyen
(74) *Attorney, Agent, or Firm* — Studebaker & Brackett PC

(57) ABSTRACT

An antenna device includes: a cavity part 1 composed of a metal conductor having an opening closed in a bottom; a first excitation circuit 10 superposed and disposed on the upper surface of the cavity part 1, and including inside thereof a first power feeding probe 13 and a first transmission line 14 that feeds electric power to the first power feeding probe 13, and radiating a radio wave of a first polarized wave; and a second cavity part 30 and a third cavity part 50 superposed and disposed on the upper surface of the first excitation circuit 10, and composed of a metal conductor having open holes, and further includes, above the first excitation circuit 10, a matching element 45 composed of a conductor.

20 Claims, 14 Drawing Sheets

(51) Int. Cl.

| | |
|---|---|
| ***H01Q 13/02*** | (2006.01) |
| ***H01Q 21/24*** | (2006.01) |
| ***H01Q 13/06*** | (2006.01) |
| ***H01Q 13/18*** | (2006.01) |
| ***H01Q 21/00*** | (2006.01) |
| ***H01Q 21/06*** | (2006.01) |
| ***H01Q 5/378*** | (2015.01) |
| ***H01Q 1/12*** | (2006.01) |
| ***H01Q 15/24*** | (2006.01) |

(52) U.S. Cl.
CPC ..... *H01Q 13/06* (2013.01); *H01Q 13/18* (2013.01); *H01Q 15/24* (2013.01); *H01Q 21/0006* (2013.01); *H01Q 21/0081* (2013.01); *H01Q 21/064* (2013.01); *H01Q 21/24* (2013.01)

(56) References Cited

U.S. PATENT DOCUMENTS

| | | | | |
|---|---|---|---|---|
| 6,317,084 | B1 | 11/2001 | Chen et al. | |
| 6,466,171 | B1 | 10/2002 | Sherman et al. | |
| 7,663,566 | B2 * | 2/2010 | Engel | H01Q 21/064 343/700 MS |
| 8,558,746 | B2 * | 10/2013 | Thomson | H01Q 21/0075 29/600 |
| 2002/0014995 | A1 | 2/2002 | Roberts | |
| 2007/0085744 | A1 | 4/2007 | Engel | |
| 2007/0290939 | A1 | 12/2007 | Teshirogi et al. | |
| 2011/0285601 | A1 | 11/2011 | Shih et al. | |

FOREIGN PATENT DOCUMENTS

| | | | |
|---|---|---|---|
| JP | H11-186837 | A | 7/1999 |
| JP | 2011-199499 | A | 10/2011 |
| JP | 2013-179440 | A | 9/2013 |

OTHER PUBLICATIONS

The extended European search report issued by the European Patent Office on Aug. 12, 2016, which corresponds io European Patent Application No. 14749632.7—1812 and is related to U.S. Appl. No. 14/758,762.

* cited by examiner

ANTENNA DEVICE AND ARRAY ANTENNA DEVICE

TECHNICAL FIELD

The present invention relates to an antenna device that transmits and receives signals in satellite communication, terrestrial radio communication, and the like, and an array antenna device that transmits and receives the signals using a plurality of antennas.

BACKGROUND ART

In satellite communication or the like, a loading space and/or a loading weight of an antenna mounted on a mobile body such as a vehicle or an airplane are limited.

Therefore, the antenna is required to be small in size and light in weight.

An array antenna that transmits and receives signals using a plurality of antennas is one means for satisfying the above requirement. As an example of a conventional array antenna for the satellite communication, as in Patent Document 1 mentioned below, there is known a configuration in which a patch antenna and an antenna obtained by stacking a metal having open holes are used.

Meanwhile, an antenna is sometimes required to be usable in orthogonal double polarization.

In order to realize this requirement, as in Patent Document 2 mentioned below, there is a method of crossing two rectangular horn antennas and vertically disposing these antennas.

Further, as a simpler configuration, as in Patent Document 3 mentioned below, there has been proposed the following method: when a power feeding probe for exciting one polarized wave is disposed on a substrate, the substrates are superposed and disposed with two layers such that the respective power feeding probes are orthogonal to each other.

Though an antenna described in Patent Document 1 mentioned below is adapted to orthogonal polarization, a patch antenna is used, and even when a non-exciting element that contributes to a wider band is added thereto, in general, the band is approximately 10%, and therefore, there is a problem such that a wider band more than the above is difficult.

An antenna described in Patent Document 3 mentioned below is adapted to the orthogonal polarization, and usable in a wide band of several tens %.

However, when a plurality of the antennas are disposed as element antennas to configure an array antenna, if all the element antennas are tournament-connected, there is a problem such that a power feeding structure is complicated to increase its manufacturing costs and manufacturing processes.

FIG. 17 shows an example of a power feeding circuit of an array antenna configured by sixty-four elements in total including eight elements in an x direction×eight elements in a y direction.

Note that the figure shows a structure adapted to the polarization in the x direction. For a power feed for the polarization in the y direction orthogonal to this direction, a structure obtained by rotating the figure 90° is further separately necessary.

When the entire power feeding circuit is configured by a waveguide in order to reduce a loss in the power feeding circuit, in addition to a complicated structure, the weight and volume of the power feeding circuit increase.

As a countermeasure against this, it is conceivable to configure a part of the power feeding circuit using a strip line on the same surface as that of a power feeding probe, vertically draw a wire down to an antenna lower part, and thereafter connect the wire using the waveguide.

In the following explanation, a drawn-down section is described as a vertical power feeding section.

FIG. 18 is an example in which only portions related to the present invention are extracted from the antenna described in Patent Document 3 mentioned below and, when four elements are set as a unit, sub-arrays are configured using a strip line.

The elements of the antenna are configured from a first cavity part 201 closed in the bottom, a first excitation circuit 210 that excites a first polarized wave, a second excitation circuit 220 that excites a second polarized wave, and a third cavity part 250 having open holes.

The first cavity part 201 is composed of, for example, a metal in which openings are cut.

Note that the bottom is closed.

The first excitation circuit 210 includes a first power feeding probe 213 configured in a dielectric substrate 211 by a pair of elements to which power is fed in phases opposite to each other for each of element antennas, and a first transmission line 214 that distributes signals to the first power feeding probes 213 of each of the element antennas.

Ground layers 215 and 216 each having open holes of the same shapes as those of the openings of the first cavity part 201 are disposed on and under the dielectric substrate 211 such that the first transmission line 214 functions as a strip line.

In addition, in order to give a structure similar to that of the cavity part 201 to the inside of the dielectric substrate 211, through-holes 212 of a metal are disposed along the openings of the first cavity part 201 to form cavity sidewalls.

The first transmission line 214 has a start point that is a crossing point with an alternate long and short dash line in the figure, and is connected to an inner conductor of a coaxial line at this point and reaches an antenna lower part piercing through a structure in a −z direction.

The second excitation circuit 220 includes a second power feeding probe 223 configured in a dielectric substrate 221 by a pair of elements to which power is fed in phases opposite to each other for each of element antennas, and a second transmission line 224 that distributes signals to the second power feeding probes 223 of the element antennas.

The second excitation circuit 220 is a structure rotated 90° from the arrangement of the first excitation circuit 210 such that a polarized wave excited by the first power feeding probe 213 and a polarized wave excited by the second power feeding probe 223 are orthogonal to each other.

Ground layers 215 and 225 each having open holes of the same shapes as those of the openings of the first cavity part 201 are disposed on and under the dielectric substrate 221 such that the second transmission line 224 functions as the strip line.

In this case, the ground layer 215 plays a role of a ground of both of the first excitation circuit 210 and the second excitation circuit 220.

In addition, in order to give a structure similar to that of the cavity part 201 to the inside of the dielectric substrate 221, the through-holes 212 of the metal are disposed along the openings of the first cavity part 201 to form the cavity sidewalls.

The second transmission line 224 has a start point that is a crossing point with the alternate long and short dash line in the figure, and is connected to the inner conductor of the coaxial line at this point and reaches the antenna lower part piercing through the structure in the −z direction.

The third cavity part 250 is composed of a metal having open holes.

A D-D' sectional view of FIG. 18 is shown in FIG. 19.

Here, a lower limit frequency at which the antenna is used is represented as fl, and an upper limit frequency at which the antenna is used is represented as fh.

In this case, it is assumed that a diameter d1 of the first cavity part 201 and a diameter d3 of the third cavity part 250 are equal.

When the antenna is regarded as a square waveguide having the diameter d1, a cutoff frequency fc in a basic mode is given by c/(2×d1), where c is the speed of light.

To enable an electromagnetic wave to propagate through the waveguide at fl, it is necessary to set d1 large such that fl>fc is satisfied.

If a diameter for satisfying fl<fc is used as d1, a cutoff occurs, reflection is deteriorated to thus decrease a gain of the antenna.

On the other hand, when an array antenna is configured using the antenna, to increase a gain of the elements while avoiding radiation in an unnecessary direction at fh, it is necessary to set d0 of an element interval smaller such that d0 is smaller than one wavelength at fh, that is, d0<c/fh is satisfied.

It is evident from the figure that d0>d3 in order to secure a wall thickness between the elements.

In this case, in the configuration of FIG. 19, a width d4 is necessary to dispose the through-holes 212, the first transmission line 214, and the second transmission line 224.

The element interval d0 is a sum of d1 and d4. The element interval exceeds one wavelength at fh.

As a result, a radiation pattern of the array antenna is deteriorated, radiation in an unnecessary direction occurs, and a gain in a desired direction decreases.

As shown in FIG. 20, it is possible to set the diameter d3 of the third cavity part 250 larger than the diameter d1 of the first cavity part 201, and densely dispose the openings. However, even in this case, a relation between d1+d4 and d0 is the same as the above one.

Conversely, when d0<c/fh is satisfied in FIG. 20, the remaining diameter d1 after d4 is secured is cut off, leading to a gain decrease.

CITATION LIST

Patent Document

Patent Document 1: Japanese Patent Application Laid-open No. H11-186837

Patent Document 2: Publication of US Patent Application No. 2007/0085744

Patent Document 3: Japanese Patent Application Laid-open No. 2011-199499

SUMMARY OF THE INVENTION

Problems to be Solved by the Invention

The conventional antenna device is configured as described above, and therefore, there is a problem such that the antenna device is not usable in a wide band and cannot be configured in a small size.

Further, there is a problem such that a radiation pattern of the conventional array antenna device is not satisfactory.

It is an object of the present invention to obtain an antenna device that is usable in a wide band and can be configured in a small size.

It is also an object of the present invention to obtain an array antenna device having a satisfactory radiation pattern.

Means for Solving the Problems

An antenna device according to the present invention includes: a cavity composed of a metal conductor having an opening closed in a bottom; a first excitation circuit superposed and disposed on the upper surface of the cavity, including inside thereof a first power feeding probe and a first transmission line that feeds electric power to the first power feeding probe, and radiating a radio wave of a first polarized wave; and a radiator superposed and disposed on the upper surface of the first excitation circuit, and composed of a metal conductor having an open hole, and further includes a first matching element composed of a conductor above the first excitation circuit; and between the first excitation circuit and the radiator, a second excitation circuit including inside thereof a second power feeding probe and a second transmission line that feeds electric power to the second power feeding probe, and radiating a radio wave of a second polarized wave orthogonal to the first polarized wave.

An array antenna device according to the present invention includes: a cavity composed of a metal conductor having a plurality of arrayed openings closed in bottoms; a first excitation circuit superposed and disposed on the upper surface of the cavity, including inside thereof a plurality of arrayed first power feeding probes and a first transmission line that feeds electric power to the first power feeding probes, and radiating a radio wave of a first polarized wave; and a radiator superposed and disposed on the upper surface of the first excitation circuit, and composed of a metal conductor having a plurality of arrayed open holes, and further includes a plurality of arrayed first matching elements composed of conductors above the first excitation circuit; and between the first excitation circuit and the radiator, a second excitation circuit including inside thereof a plurality of arrayed second power feeding probes, and a second transmission line that feeds electric power to the second power feeding probes, and radiating a radio wave of a second polarized wave orthogonal to the first polarized wave.

Effect of the Invention

According to the present invention, since the antenna device includes, above the first excitation circuit, the first matching element composed of the conductor, it is possible to improve a reflection characteristic even if the cavity is reduced in size, and therefore, there is an advantageous effect that it is possible to obtain an antenna device that is usable in a wide band and can be configured in a small size.

In addition, when a plurality of the antenna devices are arrayed, there is an advantageous effect that can obtain the array antenna device having a satisfactory radiation pattern.

Further, when with a vertical power feeding section as a waveguide, lines are respectively drawn out from opposed parts of the waveguide, and the drawn ones are connected to opposed power feeding probes of each of element antennas, there is an advantageous effect that can reduce the coupling between polarized waves.

MODES FOR CARRYING OUT THE INVENTION

Modes for carrying out the present invention are explained below according to the accompanying drawings in order to explain the present invention more in detail.

First Embodiment

An antenna device according to a first embodiment of the present invention is explained.

Figure 1:
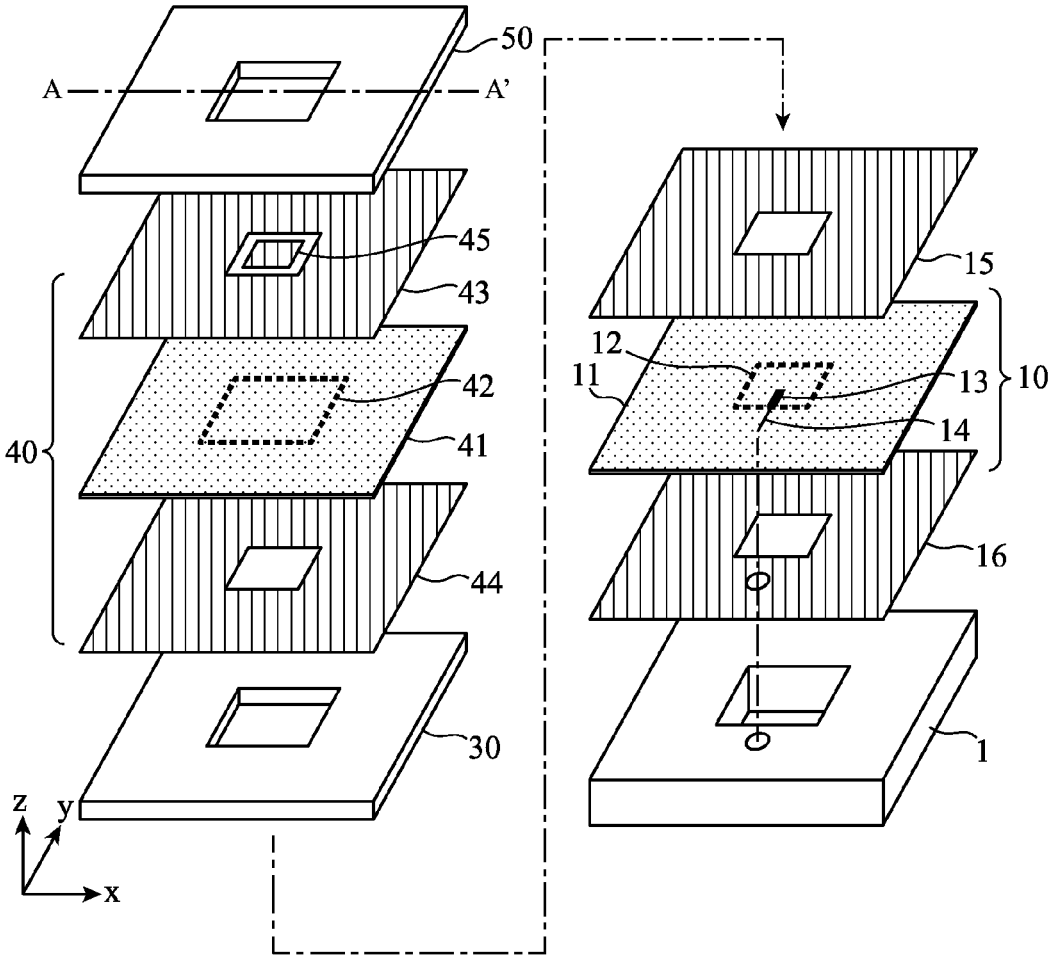
FIG. 1 is an exploded perspective view showing a configuration of an antenna according to a first embodiment of the present invention.

FIG. 1 is an exploded perspective view showing a configuration of an antenna according to the first embodiment of the present invention.

Note that, in order to simply show the configuration of the present invention, the first embodiment is assumed to be single polarization.

The antenna is composed of a first cavity part 1 closed in the bottom, a first excitation circuit 10 that excites a first polarized wave, a second cavity part (a radiation part) 30 having an open hole, a matching element section 40, and a third cavity part (a radiation part) 50 having an open hole.

The first cavity part 1 is composed of, for example, a metal in which an opening is cut.

Note that the bottom is closed.

The first excitation circuit 10 includes in a dielectric substrate 11 a first power feeding probe 13, and a first transmission line 14 that supplies a signal to the first power feeding probe 13.

Ground layers 15 and 16 each having an open hole of the same shape as that of the opening of the first cavity part 1 are disposed on and under the dielectric substrate 11 such that the first transmission line 14 functions as a strip line.

In addition, in order to give a structure similar to that of the first cavity part 1 to the inside of the dielectric substrate 11, through-holes 12 of a metal are disposed along the opening of the first cavity part 1 to form a cavity sidewall.

The first transmission line 14 has a start point that is a crossing point with an alternate long and short dash line in the figure, and is connected to an inner conductor of a coaxial line at this point and reaches an antenna lower part piercing through a structure in a −z direction.

The second cavity part 30 is composed of a metal having an open hole and adjusts the height between the first excitation circuit 10 and the matching element section 40 shown below.

Ground layers 43 and 44 each having an open hole of the same shape as that of the opening of the second cavity part 30 are disposed on and under a dielectric substrate 41 of the matching element section 40.

In order to give a structure similar to that of the second cavity part 30 to the inside of the dielectric substrate 41, through-holes 42 of a metal are disposed along the opening of the second cavity part 30 to form a cavity sidewall.

A matching element (a first matching element) 45 is disposed in the open hole part of the ground layer 43.

In the figure, the conductor is formed in a square shape. However, the conductor may be formed in a shape such as a circular shape different from the square shape.

In addition, the matching element 45 may be disposed in the open hole part of the ground layer 44.

Note that the dielectric substrate 41 is present only for retaining the matching element 45. Therefore, the dielectric substrate 41 may be removed by, for example, providing, on the cavity sidewall, a structure that retains the matching element 45.

The third cavity part 50 is composed of a metal having an open hole.

As in Patent Document 3 mentioned above, the antenna in the first embodiment has a configuration in which the power feeding probe for exciting one polarized wave is disposed on the substrate. Therefore, the antenna is usable in a wide band of several tens %.

In addition, the antenna in the first embodiment is characterized in that the first cavity part 1 is reduced in diameter.

As shown above, in the explanations of FIG. 17 to FIG. 20 in the conventional example, if the first cavity part 1 is simply reduced in diameter, a cutoff occurs at fl, leading to deterioration in a reflection characteristic thereof. However, in the first embodiment, the reflection characteristic can be improved by disposing the matching element 45.

In the first embodiment, the opening diameter of the first cavity part 1 is reduced to be equal to or smaller than the cutoff in the basic mode of the waveguide at fl.

Note that, in the antenna in FIG. 1, the matching element 45 seems to be a patch antenna. However, the antenna is established as an antenna even if the matching element 45 is absent, although the reflection characteristic is poor.

Therefore, the matching element 45 is only a structure for the purpose of matching.

Figure 2:
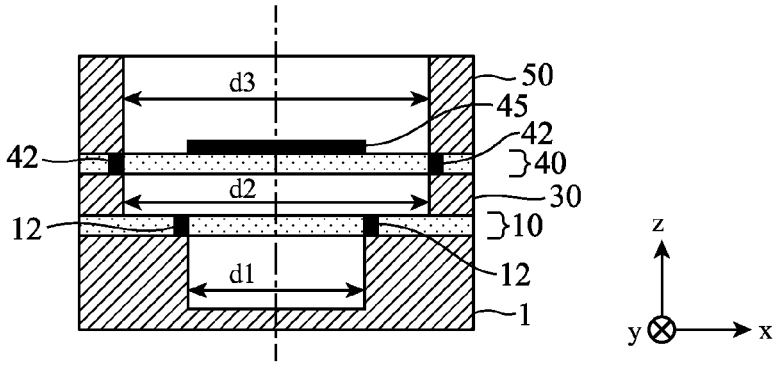
FIG. 2 is an x-z sectional view showing details of the antenna in FIG. 1.

An A-A' sectional view of FIG. 1 is shown in FIG. 2.

It is assumed that a diameter d2 of the second cavity part 30 and a diameter d3 of the third cavity part 50 are equal.

Figure 20:
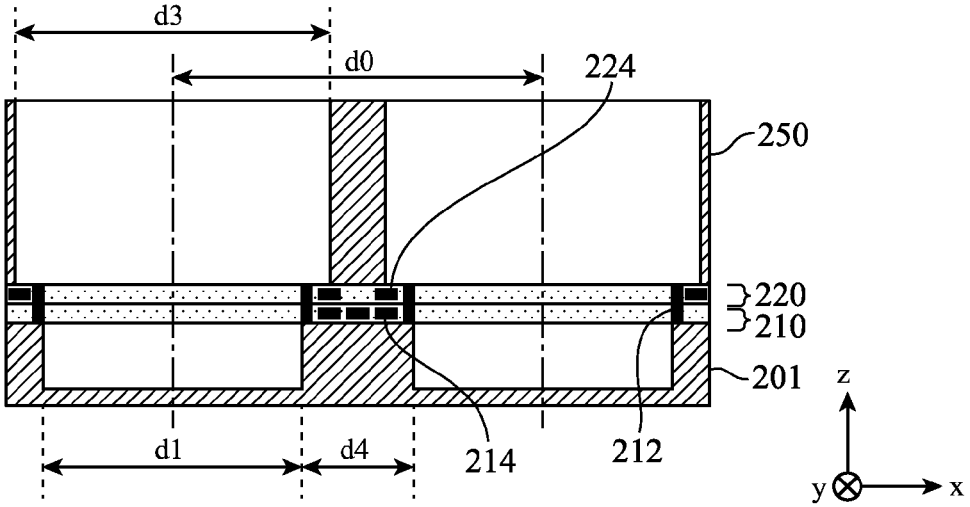
FIG. 20 is an x-z sectional view showing other details of the four-element array antenna in FIG. 18.

Compared with FIG. 20 in the conventional, if the diameter d3 is the same, d1 can be reduced in the first embodiment.

In addition, in the first embodiment, d1 can be reduced, and the distance between the through-holes 12 in the dielectric substrate 11 is substantially equal to d1.

As a result, the element is reduced in size, regions on the outer sides of the through-holes 12 at two places are wide, and therefore, even if transmission lines are disposed in the regions, it is possible to configure an array antenna in which the antennas are densely disposed.

A specific disposition of the transmission lines and effects in the array antenna are explained in embodiments described later.

Consequently, it is possible to obtain an antenna device in a wide band and in a small size used for the single polarization.

From the above, according to the first embodiment, since the matching element 45 is provided above the first excitation circuit 10, the reflection characteristic can be improved even if the first cavity part 1 is reduced in size, and therefore, it is possible to obtain the antenna device that is usable in the wide band and can be configured in the small size.

Second Embodiment

An antenna device according to a second embodiment of the present invention is explained.

Figure 3:
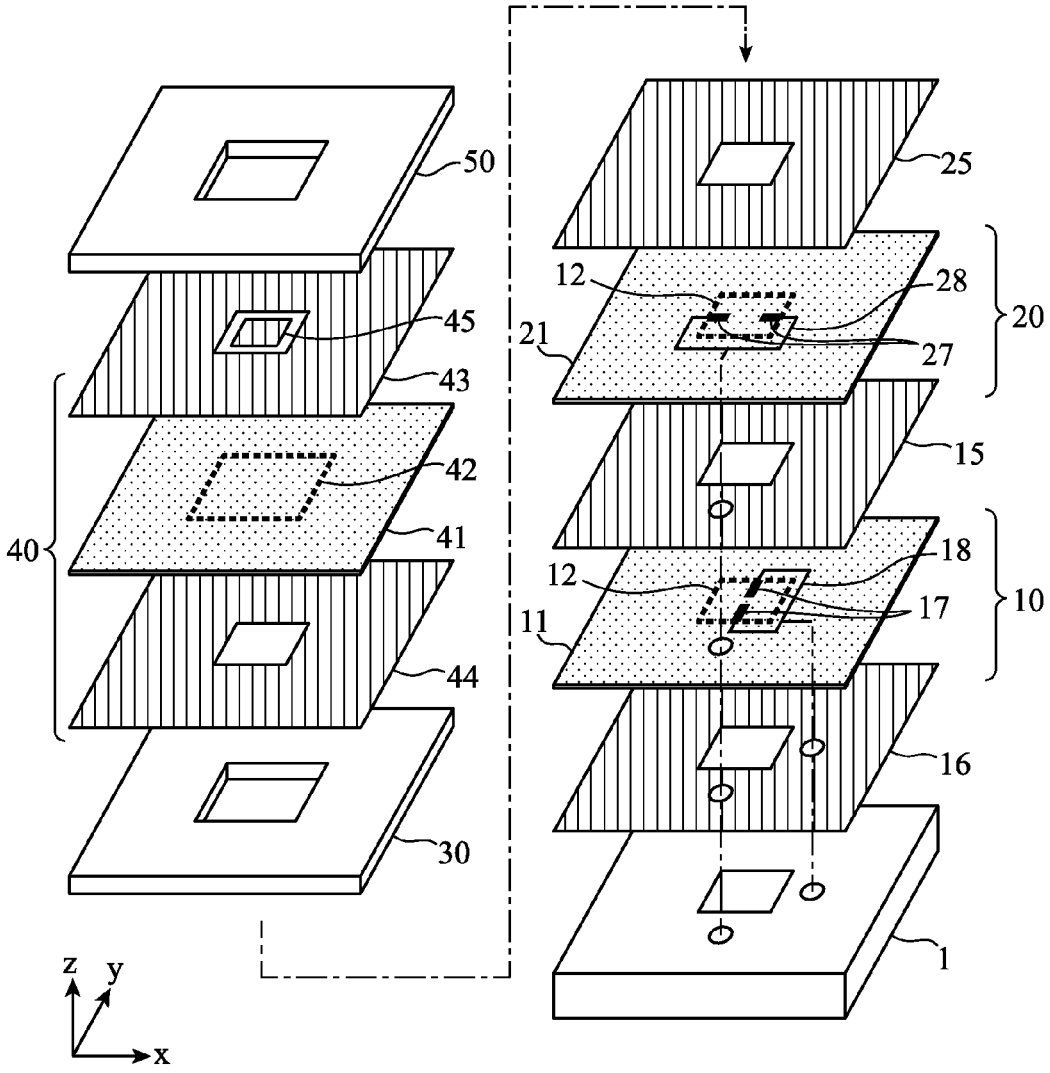
FIG. 3 is an exploded perspective view showing a configuration of an antenna according to a second embodiment of the present invention.

FIG. 3 is an exploded perspective view showing a configuration of an antenna according to the second embodiment of the present invention.

Note that, in order to simply show the configuration of the present invention, the second embodiment is assumed to be orthogonal double polarization.

In the figure, the second embodiment is the same as the first embodiment in that the antenna includes a first cavity part 1 closed in the bottom, a first excitation circuit 10 that excites a first polarized wave, a second cavity part 30 having an open hole, a matching element section 40, and a third cavity part 50 having an open hole.

Compared with the first embodiment, the second embodiment is different in the internal structure of the first excitation circuit 10, and different in that a second excitation circuit 20, a radiated polarized wave of which is orthogonal to a radiated polarized wave of the first excitation circuit 10, is added thereto.

The structures of the first cavity part 1, the second cavity part 30, the matching element section 40, and the third cavity part 50 are similar to those in the first embodiment, and therefore, explanations of the structures are omitted.

The first excitation circuit 10 is composed of two probes right opposed to each other in a dielectric substrate 11, and includes a first power feeding probe 17 configured by a pair of elements to which power is fed in phases opposite to each other and a first transmission line 18 that distributes a signal to the first power feeding probe 17.

Ground layers 15 and 16 each having an open hole of the same shape as that of the opening of the first cavity part 1 are disposed on and under the dielectric substrate 11 such that the first transmission line 18 functions as a strip line.

In addition, in order to give a structure similar to that of the first cavity part 1 to the inside of the dielectric substrate 11, through-holes 12 of a metal are disposed along the opening of the first cavity part 1 to form a cavity sidewall.

The first transmission line 18 has a start point that is a crossing point with an alternate long and short dash line in the figure, and is connected to an inner conductor (a first vertical power feeding section) of a coaxial line at this point and reaches an antenna lower part piercing through a structure in a −z direction.

The second excitation circuit 20 is composed of two probes right opposed to each other in the dielectric substrate 21, and includes a second power feeding probe 27 configured by a pair of elements to which power is fed in phases opposite to each other and a second transmission line 28 that distributes a signal to the second power feeding probe 27.

The second excitation circuit 20 is a structure rotated 90° from the first excitation circuit 10 on an x-y plane such that a polarized wave radiated by the first excitation circuit 10 and a polarized wave radiated by the second excitation circuit 20 are orthogonal to each other.

Ground layers 25 and 15 each having an open hole of the same shape as that of the opening of the first cavity part 1 are disposed on and under the dielectric substrate 21 such that the second transmission line 28 functions as the strip line.

The ground layer 15 plays a role of a ground of both of the first excitation circuit 10 and the second excitation circuit 20.

In addition, in order to give a structure similar to that of the cavity part 1 to the inside of the dielectric substrate 21, the through-holes 12 of the metal are disposed along the opening of the first cavity part 1 to form the cavity sidewall.

The second transmission line 28 has a start point that is a crossing point with the alternate long and short dash line in the figure, and is connected to an inner conductor (a second vertical power feeding section) of a coaxial line at this point and reaches the antenna lower part piercing through the structure in the −z direction.

An explanation of a sectional structure thereof is omitted because the second excitation circuit 20 is only added to FIG. 2.

As in Patent Document 3 mentioned above, the antenna in the second embodiment has the following configuration: when the power feeding probe for exciting one polarized wave is disposed on the substrate, the two substrates are superposed and disposed with two layers such that the respective power feeding probes are orthogonal to each other. Therefore, the antenna is usable in a wide band of several tens %.

In addition, the antenna in the second embodiment is characterized in that the first cavity part 1 is reduced in diameter.

As shown above, in the explanation of FIG. 17 to FIG. 20 of the conventional example, if the first cavity part 1 is simply reduced in diameter, a cutoff occurs at fl, leading to deterioration in a reflection characteristic thereof. However, in the second embodiment, the reflection characteristic can be improved when the matching element 45 is disposed.

Further, in the second embodiment, a use in the orthogonal double polarization is possible.

Consequently, it is possible to obtain the antenna device that is a wide band and adapted to the orthogonal polarization, and that is small in size.

From the above, according to the second embodiment, since the antenna includes the matching element 45 above the first excitation circuit 10 and the second excitation circuit 20, the reflection characteristic can be improved even if the first cavity part 1 is reduced in size. Therefore, it is possible to obtain the antenna device that is usable in the wide band and adapted to the orthogonal polarization, and that can be configured in a small size.

Third Embodiment

An antenna device according to a third embodiment of the present invention is explained.

Figure 4:
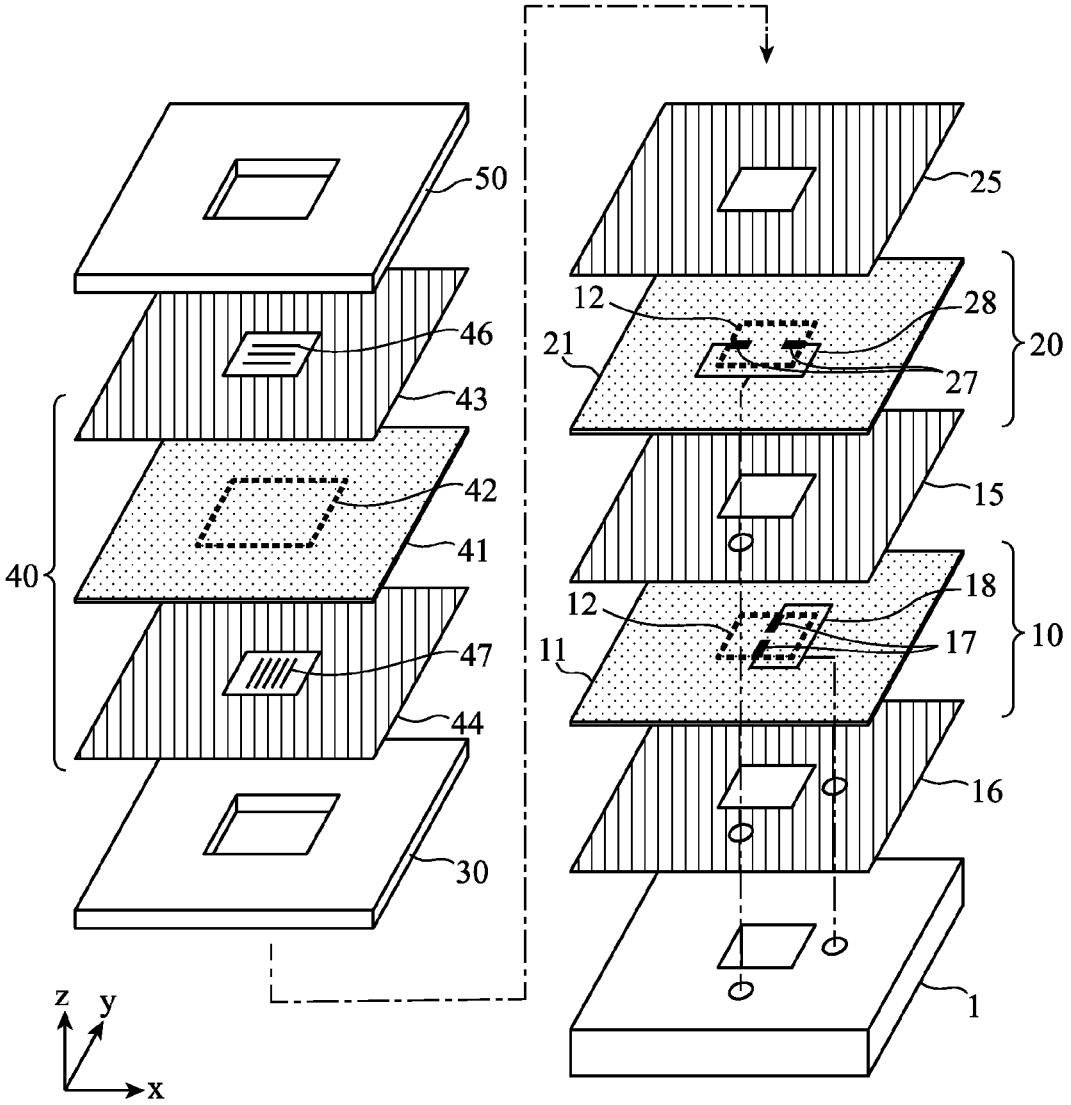
FIG. 4 is an exploded perspective view showing a configuration of an antenna according to a third embodiment of the present invention.

FIG. 4 is an exploded perspective view showing a configuration of an antenna according to the third embodiment of the present invention.

Note that, in order to simply show the configuration of the present invention, the third embodiment is assumed to be orthogonal double polarization.

In the figure, the third embodiment is the same as the second embodiment in that the antenna includes a first cavity part 1 closed in the bottom, a first excitation circuit 10 that excites a first polarized wave, a second excitation circuit 20 that excites a second polarized wave, a second cavity part (a lower radiation part) 30 having an open hole, a matching element section 40, and a third cavity part (an upper radiation part) 50 having the open hole.

Compared with the second embodiment, the third embodiment is different in the internal structure of the matching element section 40.

The structures of the first cavity part 1, the first excitation circuit 10, the second excitation circuit 20, the second cavity part 30, and the third cavity part 50 are similar to those in the second embodiment, and therefore, explanations of the structures are omitted.

Ground layers 43 and 44 each having an open hole of the same shape as that of the opening of the second cavity part 30 are disposed on and under a dielectric substrate (a dielectric substrate for a matching element) 41 of the matching element section 40.

Note that the ground layers 43 and 44 and the ground layers 15, 16, and 25 are formed of copper foils.

Through-holes 42 of a metal are disposed along the opening of the second cavity part 30 to form a cavity sidewall.

A matching element (a second matching element) 46 is disposed in the open hole part of the ground layer 43.

The matching element 46 is a conductor slit parallel to a polarized wave radiated by the second excitation circuit 20 and functions as a matching element for the polarized wave radiated by the second excitation circuit 20.

On the other hand, the slit of the matching element 46 is orthogonal to the polarized wave radiated by the first excitation circuit 10 and hardly affects the polarized wave radiated by the first excitation circuit 10.

A matching element (a first matching element) 47 is disposed in the open hole part of the ground layer 44.

The matching element 47 is a conductor slit parallel to the polarized wave radiated by the first excitation circuit 10 and functions as the matching element for the polarized wave radiated by the first excitation circuit 10.

On the other hand, the slit of the matching element 47 is orthogonal to the polarized wave radiated by the second excitation circuit 20 and hardly affects the polarized wave radiated by the second excitation circuit 20.

Therefore, the dimensions and the heights of the matching elements for the polarized waves can be independently adjusted.

In the third embodiment, the height from the first excitation circuit 10 to the matching element 47 and the height from the second excitation circuit 20 to the matching element 48 are adjusted to be equal to thus easily obtain a satisfactory radiation pattern.

An explanation of a sectional structure of a waveguide section is omitted because the second excitation circuit 20 is only added to FIG. 2.

As in Patent Document 3 mentioned above, the antenna in the third embodiment has the following configuration: when the power feeding probe for exciting one polarized wave is disposed on the substrate, the two substrates are superposed and disposed with two layers such that the respective power feeding probes are orthogonal to each other. Therefore, the antenna is usable in a wide band of several tens %.

In addition, the antenna in the third embodiment is characterized in that the first cavity part 1 is reduced in diameter.

As shown above, in the explanation of FIG. 17 to FIG. 20 of the conventional example, if the first cavity part 1 is simply reduced in diameter, a cutoff occurs at fl, leading to deterioration in a reflection characteristic thereof. However, in the third embodiment, the reflection characteristic can be improved when the matching elements 46 and 47 are disposed.

In the third embodiment, not only a use in the orthogonal double polarization is possible, but also it is possible to individually improve characteristics of both the polarized waves.

Consequently, it is possible to obtain the antenna device that is a wide band and adapted to the orthogonal polarization, and that is small in size.

From the above, according to the third embodiment, since the antenna includes the matching elements 46 and 47 above the first excitation circuit 10 and the second excitation circuit 20, the reflection characteristic can be improved even if the first cavity part 1 is reduced in size. Therefore, it is possible to obtain the antenna device that is usable in the wide band and adapted to the orthogonal polarization, which can individually improve the characteristics of both the polarized waves, and that can be configured in a small size.

Fourth Embodiment

An array antenna device according to a fourth embodiment of the present invention is explained.

Figure 5:
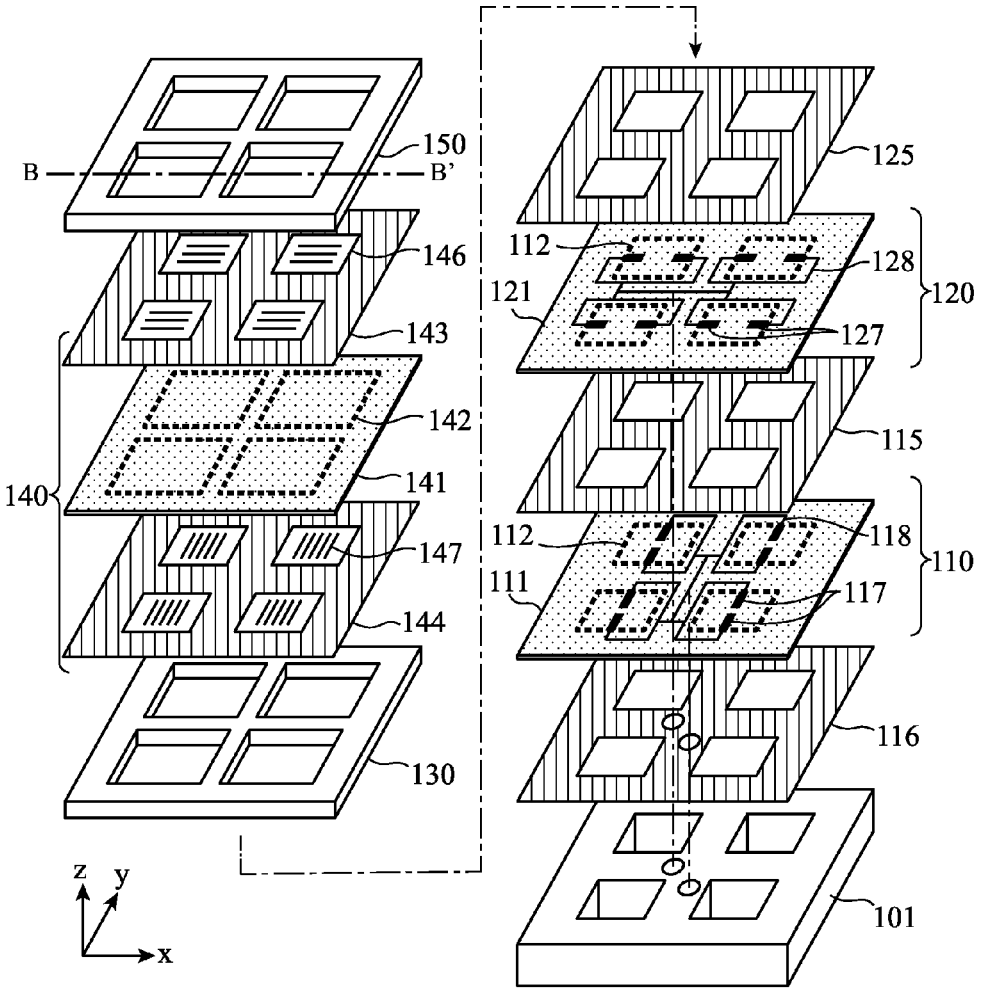
FIG. 5 is an exploded perspective view showing a configuration of a four-element array antenna according to a fourth embodiment of the present invention.

FIG. 5 is an exploded perspective view showing a configuration of a four-element array antenna according to the fourth embodiment of the present invention.

Note that, in order to simply show the configuration of the present invention, the fourth embodiment is assumed to be orthogonal double polarization.

The configuration in the fourth embodiment is similar to that in the third embodiment, but is different in that a plurality of antennas are disposed to form an array antenna, and in that power feeding circuits to elements configuring the array antenna are included in a first excitation circuit 110 and a second excitation circuit 120.

Note that the figure is an example in which four elements are set as a unit of a sub-array, and a strip line is used for the four elements. However, electric power may be fed to a larger number of elements using the strip line or a plurality of sub-arrays may be disposed to configure the entire antenna.

The antenna is configured by a first cavity part 101 closed in the bottom, the first excitation circuit 110 that excites a first polarized wave, the second excitation circuit 120 that excites a second polarized wave, a second cavity part 130 having open holes, a matching element section 140, and a third cavity part 150 having the open holes.

The first cavity part 101 is composed of, for example, a metal in which openings are cut.

Note that the bottom is closed.

The first excitation circuit 110 includes a first power feeding probe 117 configured in a dielectric substrate 111 by a pair of elements to which electric power is fed in phases opposite to each other for each of element antennas, and a first transmission line 118 that branches to distribute a signal to the first power feeding probes 117 of the element antennas.

Ground layers 115 and 116 each having open holes of the same shapes as those of the openings of the first cavity part 101 are disposed on and under the dielectric substrate 111 such that the first transmission line 118 functions as a strip line.

In order to give a structure similar to that of the first cavity part 101 to the inside of the dielectric substrate 111, through-holes 112 of a metal are disposed along the openings of the first cavity part 101 to form cavity sidewalls.

The first transmission line 118 has a start point that is a crossing point with an alternate long and short dash line in the figure, and is connected to an inner conductor of a coaxial line at this point and reaches an antenna lower part piercing through a structure in a −z direction.

A connection thereafter is performed in the same manner as in the conventional example. For example, a connection by a waveguide is performed. However, the number of branches of the waveguide is reduced and thus, the configuration is simplified.

The second excitation circuit 120 includes a second power feeding probe 127 configured in a dielectric substrate 121 by a pair of elements to which power is fed in phases opposite to each other for each of element antennas, and a second transmission line 128 that branches to distribute a signal to the second power feeding probes 127 of each of the element antennas.

The second excitation circuit 120 is a structure rotated 90° from the arrangement of the first excitation circuit 110 such that a polarized wave exited by the first power feeding probe 117 and a polarized wave excited by the second power feeding probe 127 are orthogonal to each other.

Ground layers 125 and 115 each having open holes of the same shapes as those of the openings of the first cavity part 101 are disposed on and under the dielectric substrate 121 such that the second transmission line 128 functions as the strip line.

In this case, the ground layer 115 plays a role of a ground of both of the first excitation circuit 110 and the second excitation circuit 120.

In addition, in order to give a structure similar to that of the cavity part 101 to the inside of the dielectric substrate 121, the through-holes 112 of the metal are disposed along the openings of the first cavity part 101 to form the cavity sidewalls.

The second transmission line 128 has a start point that is a crossing point with the alternate long and short dash line in the figure, and is connected to an inner conductor of a coaxial line at this point and reaches the antenna lower part piercing through the structure in the −z direction.

A connection thereafter is performed in the same manner as in the conventional. For example, a connection by the waveguide is performed. However, the number of branches of the waveguide is reduced and thus, the configuration is simplified.

The second cavity part 130 is composed of a metal having open holes and adjusts the height between the first excitation circuit 110 and second excitation circuit 120, and the matching element section 140 shown below.

Ground layers 143 and 144 each having open holes of the same shapes as those of the openings of the second cavity part 130 are disposed on and under the dielectric substrate 141 of the matching element section 140.

Note that the ground layers 143 and 144 and the ground layers 115, 116, and 125 are formed of copper foils.

The through-holes 142 of a metal are disposed along the openings of the second cavity part 130 to form the cavity sidewalls.

Matching elements 146 are disposed in the open hole parts of the ground layer 143.

The matching elements 146 are conductor slits parallel to a polarized wave radiated by the second excitation circuit 120, and function as matching elements for the polarized wave radiated by the second excitation circuit 120.

On the other hand, the slits of the matching elements 146 are orthogonal to the polarized wave radiated by the first excitation circuit 110 and hardly affect the polarized wave radiated by the first excitation circuit 110.

Matching elements 147 are disposed in the open hole parts of the ground layer 144.

The matching elements 147 are conductor slits parallel to the polarized wave radiated by the first excitation circuit 110 and function as matching elements for the polarized wave radiated by the first excitation circuit 110.

On the other hand, the slits of the matching elements 147 are orthogonal to the polarized wave radiated by the second excitation circuit 120 and hardly affect the polarized wave radiated by the second excitation circuit 120.

Therefore, the dimensions and heights of the matching elements for the polarized waves can be independently adjusted.

The third cavity part 150 is composed of a metal having open holes.

Figure 6:
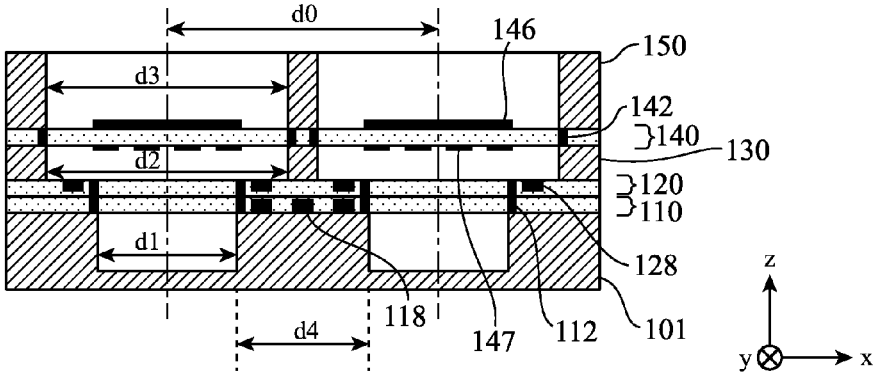
FIG. 6 is an x-z sectional view showing details of the four-element array antenna in FIG. 5.

A B-B' sectional view of FIG. 5 is shown in FIG. 6.

A lower limit frequency at which the antenna is used is represented as fl and an upper limit frequency at which the antenna is used is represented as fh.

It is assumed that a diameter d2 of the second cavity part 130 and a diameter d3 of the third cavity part 150 are equal.

When the array antenna is configured using the antenna, to increase a gain of the elements while avoiding the radiation in an unnecessary direction at fh, it is necessary to set d0 of an element interval small such that d0 is smaller than one wavelength at fh, that is, $d0<c/fh$ is satisfied.

It is evident from the figure that $d0>d3$ in order to secure a wall thickness between the elements.

In this case, in the configuration of FIG. 6, a width d4 is necessary to dispose the through-holes 112, the first transmission line 118, and the second transmission line 128.

In the fourth embodiment, by providing the matching elements 146 and 147, d1 can be reduced. The distance between the through-holes 112 in the dielectric substrate 111 is substantially equal to d1.

As a result, the elements are reduced in size. Regions on the outer sides of the through-holes 112 at two places are wide. Therefore, the transmission lines can be disposed in the regions.

The element interval d0 is a sum of d1 and d4. However, since d1 can be reduced, it is possible to configure an array antenna in which the element interval does not exceed one wavelength at fh, and thus the antennas are densely disposed.

Figure 7:
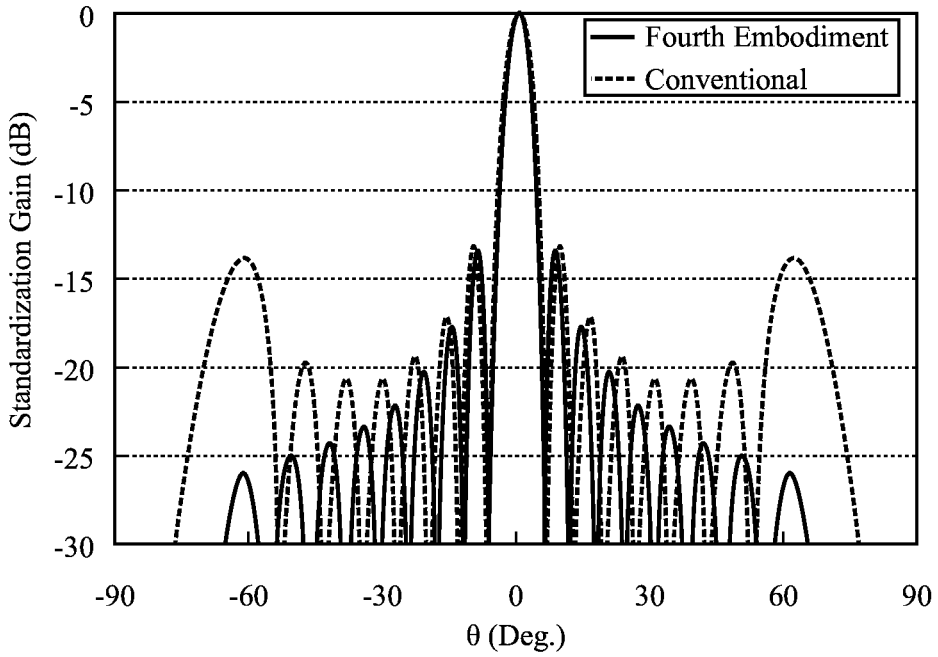
FIG. 7 is a characteristic chart showing radiation patterns obtained when array antennas are configured using an element interval according to the fourth embodiment of the present invention and a conventional element interval.

FIG. 7 shows an example of radiation patterns obtained when array antennas configured by sixty-four elements in total including eight elements in an x direction×eight elements in a y direction are configured using the element interval in the fourth embodiment and the conventional element interval.

Note that, the element antenna intervals are the same in both of the x direction and y direction, and that a radiation pattern on an x-z plane and a radiation pattern on a y-z plane are the same.

In FIG. 6, the element interval d0 in the fourth embodiment is set to 0.97λ at the upper limit frequency fh, and the opening diameter d1 of the first cavity part 101 is set to 0.4λ.

The width d4 of the gap between the adjacent openings of the first cavity part 101 is 0.57λ, and thus, the first transmission line 118 and the second transmission line 128 can be easily disposed.

Figure 19:
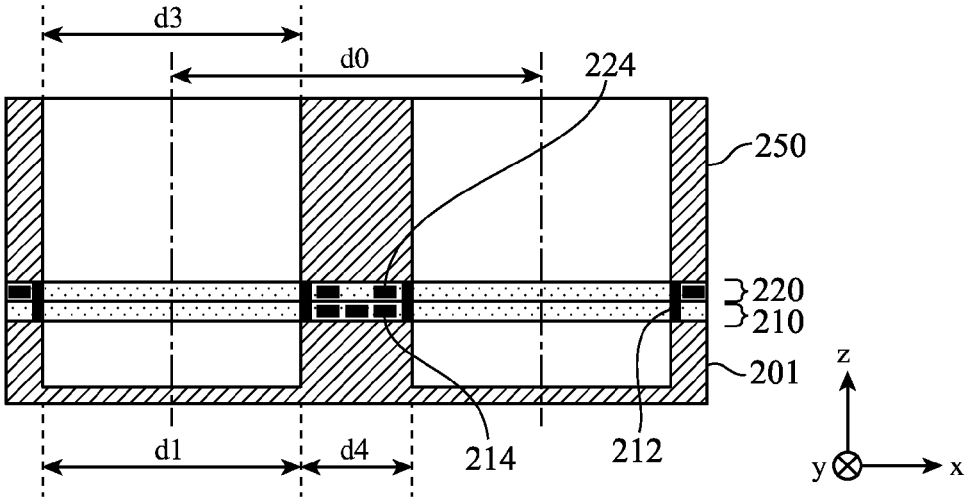
FIG. 19 is an x-z sectional view showing details of the four-element array antenna in FIG. 18.

On the other hand, in the FIG. 19 of the conventional, when 0.73λ is required for the opening diameter d1 of the first cavity part 1 and 0.37λ is required for the width d4 of the gap of the adjacent first cavity part 1, the element interval d0 is 1.1λ.

In FIG. 7, the element interval exceeds 1λ in the conventional. A grating lobe which is radiation in an unnecessary direction occurs.

A lobe near ±60° corresponds to the grating lobe.

On the other hand, since the element interval is smaller than 1λ, the grating lobe does not occur.

Consequently, it is possible to obtain the array antenna device that is a wide band and adapted to the orthogonal polarization, and that even if the strip lines are disposed among the antennas to configure the array antenna, the grating lobe is eliminated to have a satisfactory radiation pattern.

From the above, according to the fourth embodiment, the array antenna device is configured such that the plurality of the antennas in the third embodiment are disposed to provide the array antenna, and that the power feeding circuits to the elements configuring the array antenna are included in the first excitation circuit 110 and the second excitation circuit 120. Therefore, it is possible to obtain the array antenna device that is usable in the wide band and adapted to the orthogonal polarization, which can individually improve characteristics of both the polarized waves, and that even if the strip lines are disposed among the antennas to configure the array antenna, the grating lobe is eliminated to have the satisfactory radiation pattern.

Fifth Embodiment

An antenna array device according to a fifth embodiment of the present invention is explained.

Figure 8:
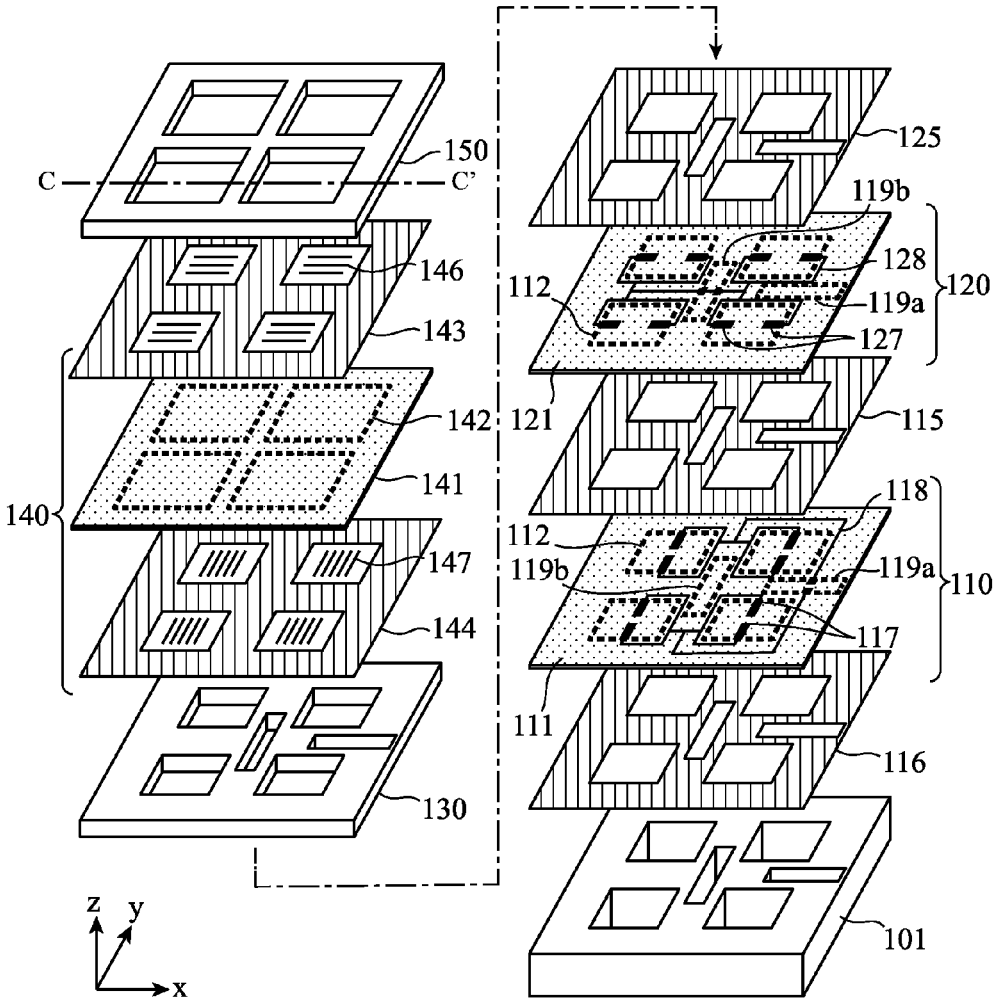
FIG. 8 is an exploded perspective view showing a configuration of a four-element array antenna according to a fifth embodiment of the present invention.

FIG. 8 is an exploded perspective view showing a configuration of a four-element array antenna according to the fifth embodiment of the present invention.

Note that, in order to simply show the configuration of the present invention, the fifth embodiment is assumed to be orthogonal double polarization.

The configuration in the fifth embodiment is the same as that in the fourth embodiment, but is different in that waveguides are used for a connection from an antenna bottom to a first excitation circuit 110 and a second excitation circuit 120.

Note that the figure is an example in which four elements are set as a unit of a sub-array, and a strip line is used for the four elements. However, electric power may be fed to a larger number of elements using the strip line or a plurality of sub-arrays may be disposed to configure the entire antenna.

The structures of a matching element section 140 and a third cavity part 150 are similar to those in the fourth embodiment, and therefore, explanations of the structures are omitted.

Two flat holes of a first cavity part 101 are open holes and are waveguides from the antenna bottom.

Ground layers 115, 116, and 125 have open holes corresponding to the waveguides.

In order to give a structure similar to that of the waveguides to the dielectric substrate 111 of the first excitation circuit 110, through-holes 119*a* and 119*b* of a metal are disposed along a waveguide shape to form waveguide sidewalls.

In addition, the first transmission line 118 is connected to the through-hole 119*a*.

Figure 9:
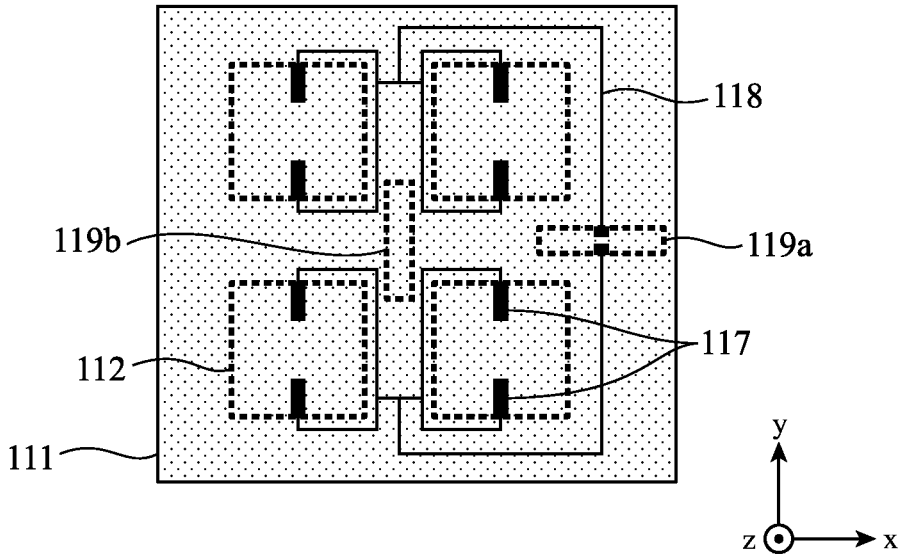
FIG. 9 is an x-y plan view showing details of an excitation circuit in FIG. 8.

Details of an x-y plane of the first excitation circuit 110 are shown in FIG. 9.

The through-hole 119*a* forming a flat rectangle on the right side in the figure is a waveguide structure corresponding to the first excitation circuit 110.

The through-hole 119*b* forming a flat rectangle in the center in the figure is a waveguide structure corresponding to the second excitation circuit 120, and passes through the first excitation circuit 110.

In order to give a structure similar to that of the waveguide to the dielectric substrate 121 of the second excitation circuit 120, the through-holes 119*b* of the metal are disposed along the waveguide shape to form the waveguide sidewalls.

In addition, the second transmission line 128 is connected to the through-holes 119*b*.

Two flat holes of a second cavity part 130 are back-short sections of the waveguides, and closed by a ground layer 144.

Note that through-holes along the waveguide shape may be provided in a dielectric substrate 141, caused to pass through the ground layer 144, and closed by a ground layer 143.

Figure 10:
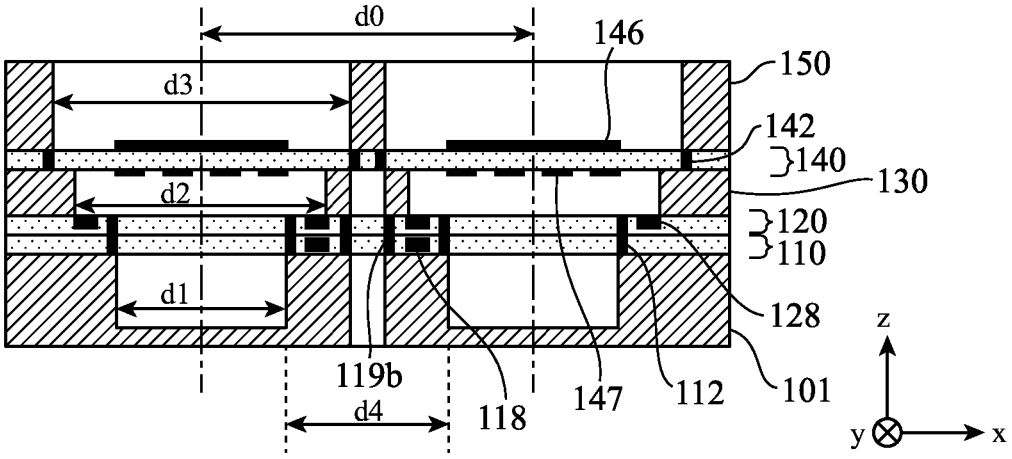
FIG. 10 is an x-z sectional view showing details of a four-element array antenna in FIG. 8.

A C-C' sectional view of FIG. 8 is shown in FIG. 10.

It is assumed that a diameter d2 of the second cavity part 130 is smaller than a diameter d3 of the third cavity part 150.

The center in the figure is the waveguide structure from the antenna bottom.

An element interval d0 is the same as that in the fourth embodiment. It is possible to configure an array antenna in which the element interval does not exceed one wavelength at fh and thus antennas are densely disposed.

Further, a short surface of the waveguide from the antenna bottom is the ground layer 144 of the matching element section 140. Consequently, new machining for forming the short surface is unnecessary, so that the structure can be simplified.

Consequently, it is possible to obtain the array antenna device with a simple structure that is a wide band and adapted to the orthogonal polarization, and that even if the strip lines are disposed among the antennas to configure the array antenna, a grating lobe is eliminated to have a satisfactory radiation pattern.

From the above, according to the fifth embodiment, in the configuration in the fourth embodiment, it is configured such that the waveguides are used for the connections from the antenna bottom to the first excitation circuit 110 and the second excitation circuit 120. Therefore, it is possible to obtain the array antenna device with the simple structure that is usable in the wide band and adapted to the orthogonal polarization, which can individually improve characteristics of both the polarized waves, and that even if the strip lines are disposed among the antennas to configure the array antenna, the grating lobe is eliminated to have the satisfactory radiation pattern.

Sixth Embodiment

An antenna device according to a sixth embodiment of the present invention is explained.

Figure 11:
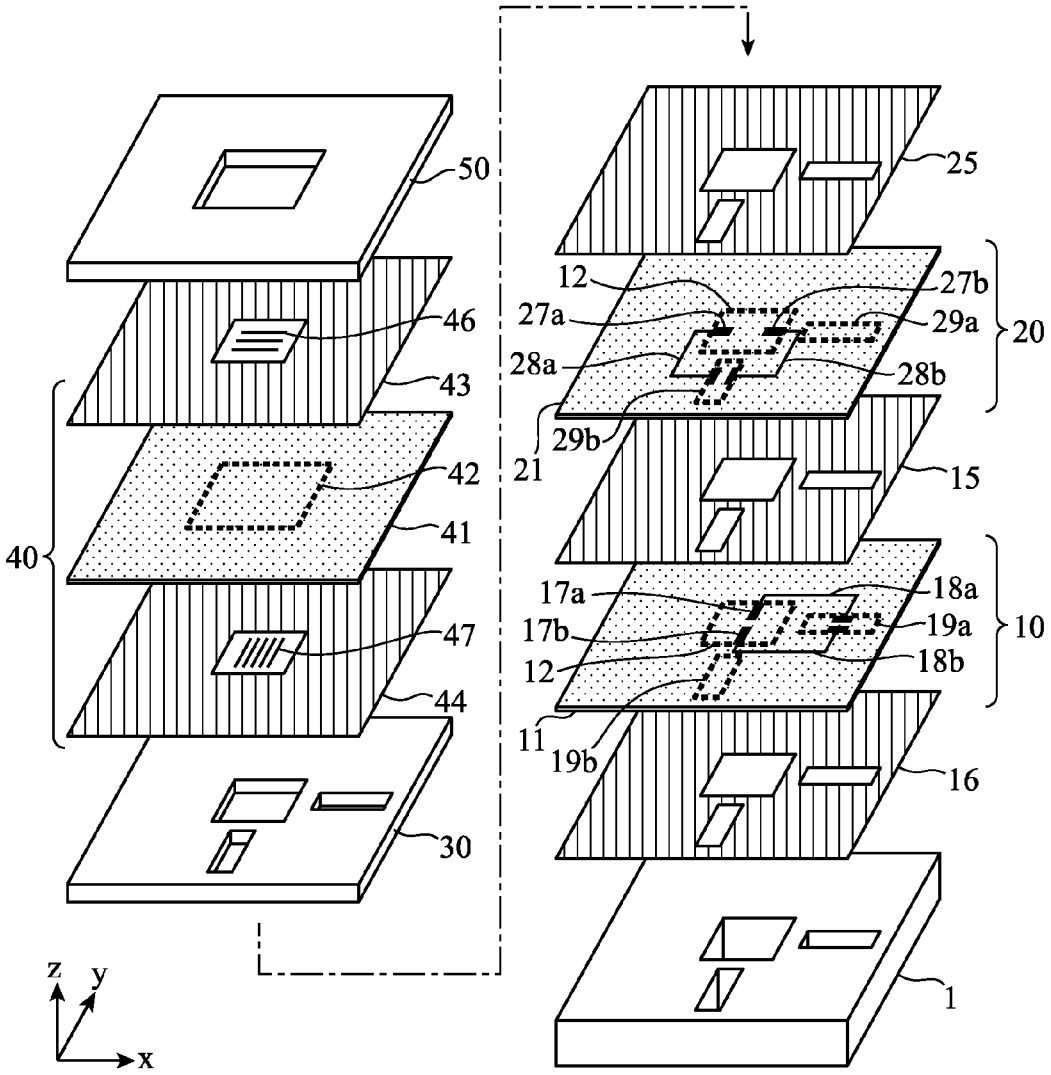
FIG. 11 is an exploded perspective view showing a configuration of an antenna according to a sixth embodiment of the present invention.

FIG. 11 is an exploded perspective view showing a configuration of an antenna according to the sixth embodiment of the present invention.

Note that, in order to simply show the configuration of the present invention, the sixth embodiment is assumed to be orthogonal double polarization.

The configuration in the sixth embodiment is similar to that in the third embodiment, but is different in that waveguides are used for connections from an antenna bottom to a first excitation circuit 10 and a second excitation circuit 20. In addition, the configuration has a feature in a wiring of a transmission line.

The structures of a matching element section 40 and a third cavity part 50 are similar to those in the third embodiment, and therefore, explanations of the structures are omitted.

Two flat holes of a first cavity part 1 are open holes and waveguides from the antenna bottom.

Ground layers 15, 16, and 25 have open holes corresponding to the waveguides.

In order to give a structure similar to that of the waveguides to a dielectric substrate 11 of the first excitation circuit 10, through-holes 19*a* and 19*b* of a metal are disposed along a waveguide shape to form waveguide sidewalls.

Figure 12:
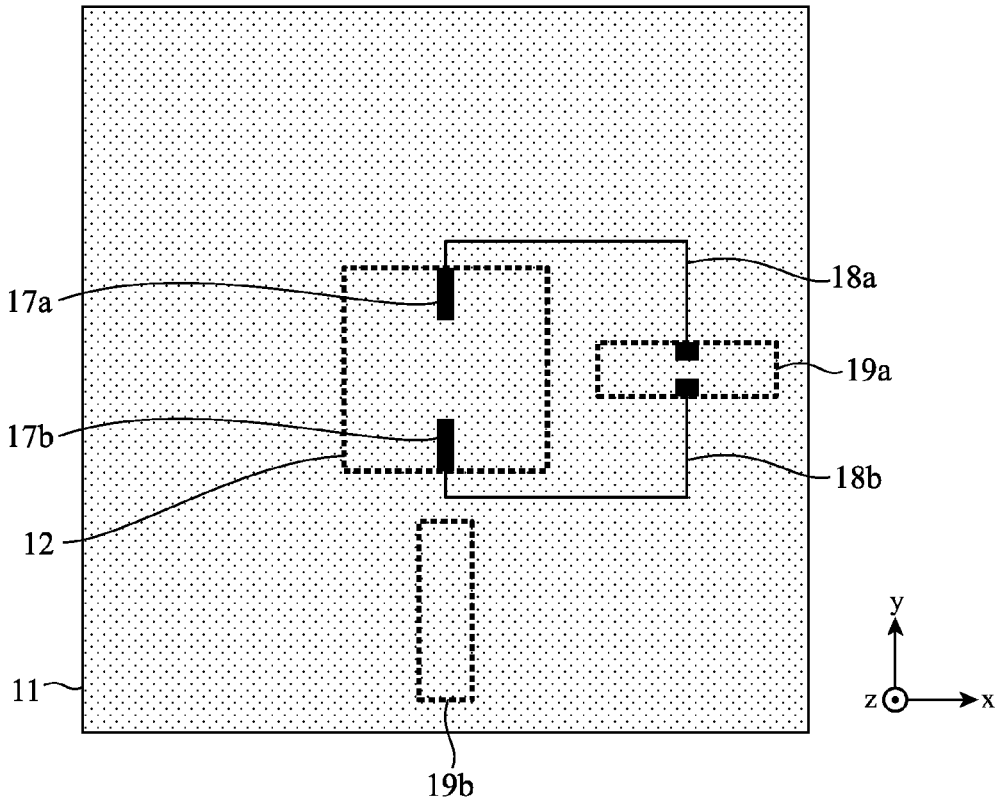
FIG. 12 is an x-y plan view showing details of an excitation circuit in FIG. 11.

Details of an x-y plane of the first excitation circuit 10 are shown in FIG. 12.

The through-hole 19*a* forming a flat rectangle on the right side in the figure is a waveguide structure (a first waveguide section) corresponding to the first excitation circuit 10.

The through-hole 19*b* forming a flat rectangle in a lower part of the figure is a waveguide structure (a second waveguide section) corresponding to the second excitation circuit 20, and a signal in this portion passes through the first excitation circuit 10.

The wiring of the transmission wires which is the feature of the sixth embodiment is explained with reference to FIG. 12.

One end portions of a first transmission line (a third transmission line) 18*a* and a first transmission line (a fourth transmission line) 18*b* are respectively directly connected to a first power feeding probe (a third power feeding probe) 17*a* and a first power feeding probe (a fourth power feeding probe) 17*b* opposed to each other. The other end portions of the first transmission lines 18*a* and 18*b* are connected to parts opposed to each other of the through-hole 19*a* configuring a waveguide section.

In this case, in the first transmission lines 18*a* and 18*b*, phase characteristics with respect to frequencies (so-called "frequency characteristics of phases") have equal characteristics, and electric characteristics have equal characteristics, and phases of signals are phases opposite to each other irrespective of frequencies. Consequently, the first power feeding probes 17*a* and 17*b* are excited in the phases opposite to each other irrespective of the frequencies.

The second excitation circuit 20 is a structure rotated 90° from the first excitation circuit 10 on an x-y plane.

That is, through-holes 29*a* and 29*b* of the metal are disposed on a dielectric substrate 21 of the second excitation circuit 20 to form the waveguide sidewalls. One end portions of a second transmission line (a fifth transmission line) 28*a* and the second transmission line (a sixth transmission line) 28*b* are respectively directly connected to a second power feeding probe (a fifth power feeding probe) 27*a* and the second power feeding probe (a sixth power feeding probe) 27*b* opposed to each other. The other end portions of the second transmission lines 28*a* and 28*b* are connected to parts opposed to each other of the through-hole 29*a*.

Two flat holes of the second cavity part 30 is back-short sections of the waveguides, and are non-open holes closed on the upper surfaces.

Note that the holes may pierce through the second cavity part 30 to be closed by the ground layer 44. In addition, through-holes along the waveguide shape may be provided in a dielectric substrate 41, caused to pass through a ground layer 44, and closed by a ground layer 43. Further, the waveguide structure corresponding to the first excitation circuit 10 may be closed by the ground layer 25 without providing the holes in the waveguide structure.

Consequently, the first power feeding probes 17*a* and 17*b* opposed to each other are excited in the phases opposite to each other irrespective of the frequencies, and the second power feeding probes 27*a* and 27*b* opposed to each other are excited in the phases opposite to each other irrespective of the frequencies, and therefore, it is possible to suppress reflection with respect to the waveguide sections. In addition, since the couplings between the first power feeding probes 17*a* and 17*b* and the second power feeding probes 27*a* and 27*b* are offset, it is possible to reduce the coupling between the polarized waves.

From the above, according to the sixth embodiment, in the configuration of the third embodiment, the waveguides are used for the connections from the antenna bottom to the first excitation circuit 10, and the second excitation circuit 20 and the transmission lines are configured to excite the first power feeding probes 17*a* and 17*b* in the phases opposite to each other irrespective of the frequencies and excite the second power feeding probes 27*a* and 27*b* in the phases opposite to each other irrespective of the frequencies. Consequently, it is possible to obtain the antenna device that is usable in a wide band and adapted to the orthogonal polarization, which can individually improve the characteristics of both the polarized waves, and that can be configured in a small size, and further is reduced in the coupling between the polarized waves.

Seventh Embodiment

An array antenna device according to a seventh embodiment of the present invention is explained.

Figure 13:
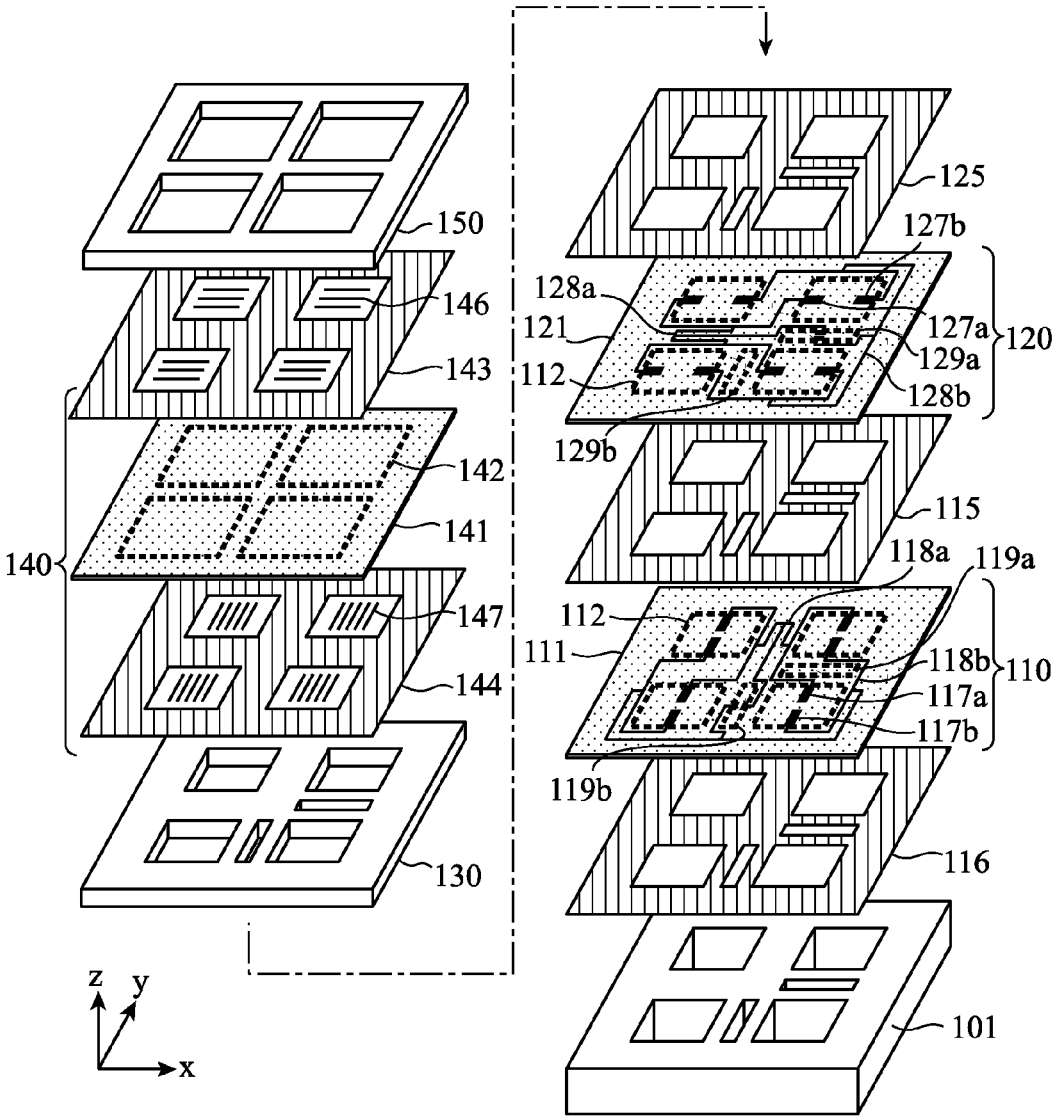
FIG. 13 is an exploded perspective view showing a configuration of a four-element array antenna according to a seventh embodiment of the present invention.

FIG. 13 is an exploded perspective view showing a configuration of a four-element array antenna according to the seventh embodiment of the present invention.

Note that, in order to simply show the configuration of the present invention, the seventh embodiment is assumed to be orthogonal double polarization.

The configuration in the seventh embodiment is similar to that in the fifth embodiment, but is different in a disposition of waveguides and a wiring of transmission lines.

Note that the figure shows a configuration in which four elements are set as a unit of a sub-array and a strip line is used for the four elements. However, electric power may be fed to a larger number of elements using the strip line or a plurality of sub-arrays may be further disposed to configure the array antenna.

The structures of a matching element section 140 and a third cavity part 150 are similar to those in the fifth embodiment, and therefore, explanations of the structures are omitted.

Figure 14:
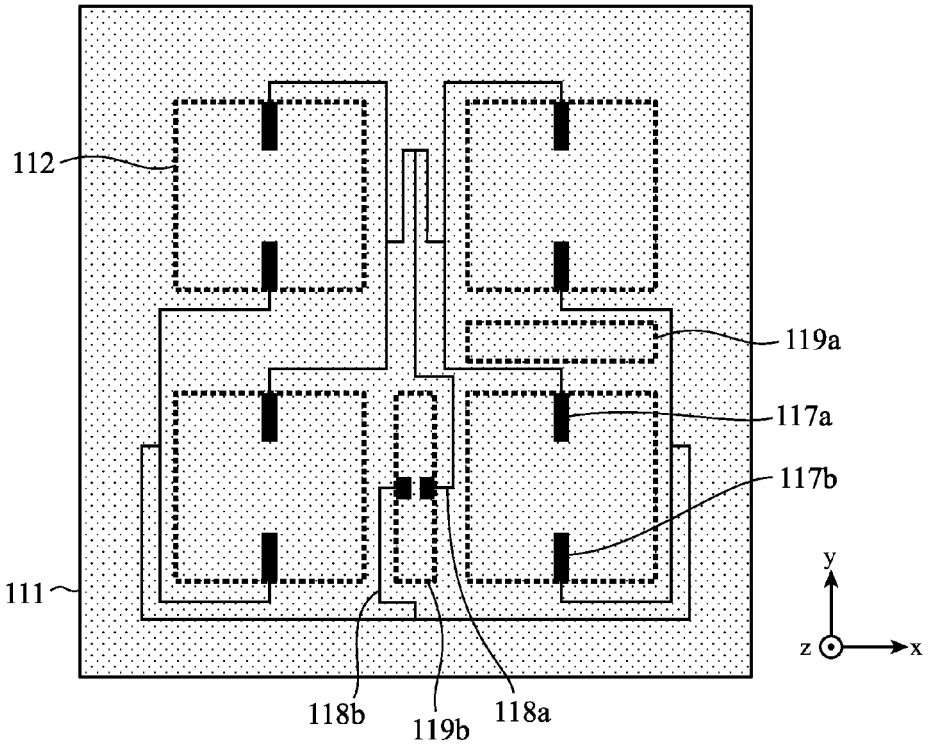
FIG. 14 is an x-y plan view showing details of an excitation circuit in FIG. 13.

Details of an x-y plane of a first excitation circuit 110 are shown in FIG. 14.

A through-hole 119*a* forming a flat rectangle on the right side in the figure is a waveguide structure (a first waveguide section) corresponding to the first excitation circuit 110.

A through-hole 119*b* forming a flat rectangle in a lower part of the figure is a waveguide structure (a second waveguide section) corresponding to a second excitation circuit 120, and a signal in this portion passes through the first excitation circuit 110.

The wiring of the transmission lines which is a feature of the seventh embodiment is explained with reference to FIG. 14.

One end portion of a first transmission line (a third transmission line) 118*a* branches, and the branched first transmission lines 118*a* are directly connected respectively to first power feeding probes (third power feeding probes) 117*a* of elements. In addition, one end portion of a first transmission line (a fourth transmission line) 118*b* branches, and the branched first transmission lines 118*b* are directly connected respectively to first power feeding probes (fourth power feeding probes) 117*b* opposed thereto of the elements. The other end portions of the first transmission lines 118*a* and 118*b* are connected to parts opposed to each other of the through-hole 119*a* configuring the waveguide section.

In this case, the first transmission line 118*a* from the through-hole 119*a* to the first power feeding probes 117*a* of the elements are configured to have an equal phase characteristic with respect to a frequency and configured to have an equal electric characteristic. In addition, the first transmission line 118*b* from the through-hole 119*a* to the first power feeding probes 117*b* of the elements are configured to have the equal phase characteristic with respect to the frequency, and configured to have the equal electric characteristic. Further, the first transmission line 118*a* from the through-hole 119*a* to the respective first power feeding probes 117*a* and the first transmission line 118*b* to the first power feeding probes 117*b* opposed thereto are configured to have the equal phase characteristic with respect to the frequency, and configured to have the equal electric characteristic, and phases of signals are opposite to each other irrespective of the frequencies. Consequently, the first power feeding probes 117*a* and 117*b* are excited in the phases opposite to each other irrespective of the frequencies.

Note that, in order to match the electric characteristics of the transmission lines, the first transmission line 118*a* and 118*b* are wired with an equal length. In addition, the phase characteristics may be finely adjusted, for example, using an electromagnetic field simulation.

The second excitation circuit 120 is a structure rotated 90° from the first excitation circuit 110 on an x-y plane.

That is, through-holes 129*a* and 129*b* of a metal are disposed on the dielectric substrate 121 of the second excitation circuit 120 to form waveguide sidewalls. One end portion of a second transmission line (a fifth transmission line) 128*a* branches, and the branched ones are directly connected respectively to second power feeding probes (fifth power feeding probes) 127*a* of elements. In addition, one end portion of a second transmission line (a sixth transmission line) 128*b* branches, and the branched ones are directly connected respectively to second power feeding probes (sixth power feeding probes) 127*b* opposed thereto of the elements. The other end portions of the second transmission lines 128*a* and 128*b* are connected to parts opposed to each other of a through-hole 129*b* configuring the waveguide section.

Consequently, the first power feeding probes 117*a* and 117*b* opposed to each other are excited in the phases opposite to each other irrespective of the frequencies. The second power feeding probes 127*a* and 127*b* opposed to each other are excited in the phases opposite to each other irrespective of the frequencies, and consequently, it is possible to suppress reflection with respect to the waveguide section. Since the couplings between the first power feeding probes 117*a* and 117*b* and the second power feeding probes 127*a* and 127*b* are offset, it is possible to reduce the coupling between the polarized waves.

From the above, according to the seventh embodiment, in the configuration of the fifth embodiment, the waveguides are used for the connections from the antenna bottom to the first excitation circuit 110 and the second excitation circuit 120, and the transmission lines are configured that the first power feeding probes 117*a* and 117*b* are excited in the phases opposite to each other irrespective of the frequencies, and the second power feeding probes 127*a* and 127*b* are excited in the phases opposite to each other irrespective of the frequencies. Consequently, it is possible to obtain the array antenna device with a simple structure that is usable in a wide band and adapted to the orthogonal polarization, which can individually improve the characteristics of both the polarized waves, and that even if the strip line is disposed among the antennas to configure the array antenna, a grating lobe can be eliminated to have a satisfactory radiation pattern, and that the coupling between the polarized waves is further reduced.

Figure 15:
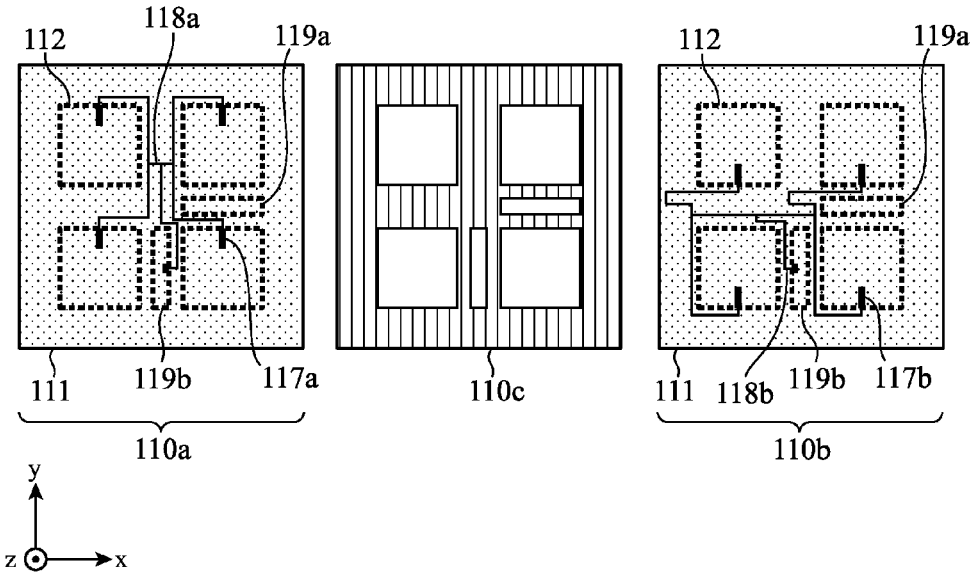
FIG. 15 is an x-y plan view showing other details of the excitation circuit in FIG. 14.

Note that, as shown in FIG. 15, the first excitation circuit 110 may be divided into two layers of a third excitation circuit 110*a* and a fourth excitation circuit 110*b*, a ground layer 110*c* may be provided between the two layers, a first power feeding probe 117*a* and a first transmission line 118*a* may be disposed in the third excitation circuit 110*a*, and a first power feeding probe 117*b* and a first transmission line 118*b* may be disposed in the fourth excitation circuit 110*b*.

Similarly, the second excitation circuit 120 may be divided into two layers of a fifth excitation circuit 120*a* and a sixth excitation circuit 120*b*, a ground layer 120*c* may be provided between the two layers, a second power feeding probe 127*a* and a second transmission line 128*a* may be disposed in the fifth excitation circuit 120*a*, and a second power feeding probe 127*b* and a second transmission line 128*b* may be disposed in the sixth excitation circuit 120*b*, so that the excitation circuits in four layers in total may be used.

Figure 16:
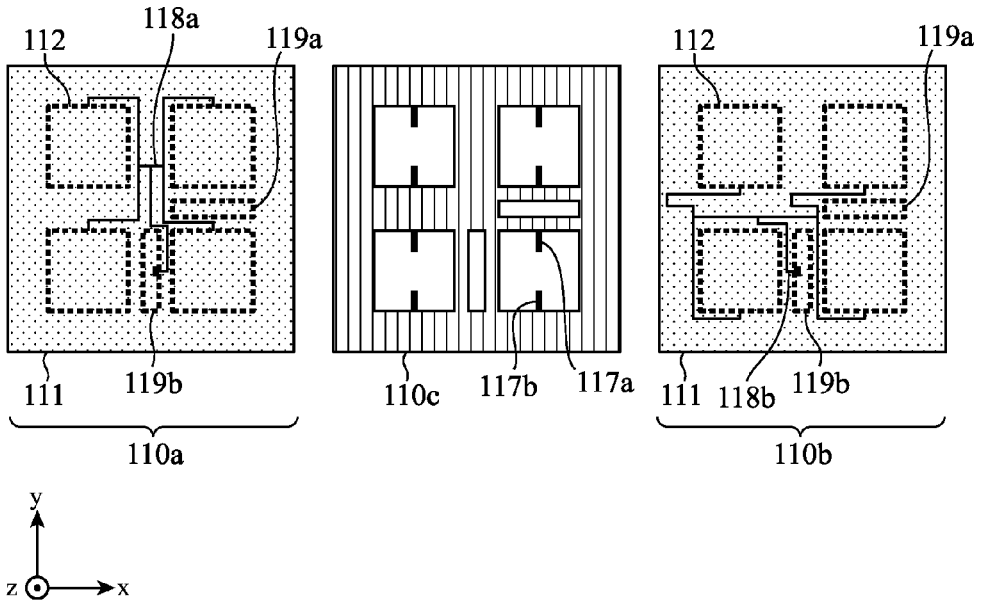
FIG. 16 is an x-y plan view showing other details of the excitation circuit in FIG. 14.
Figure 17:
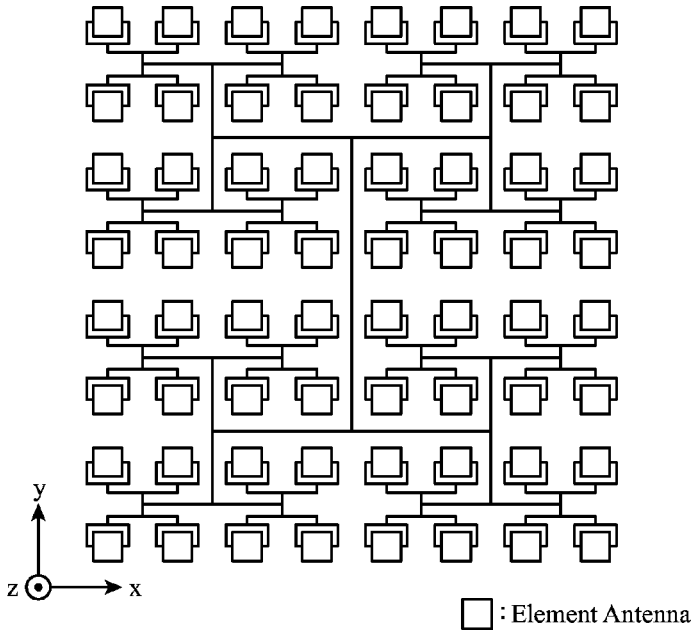
FIG. 17 is a plan view showing a power feeding circuit of a conventional array antenna.
Figure 18:
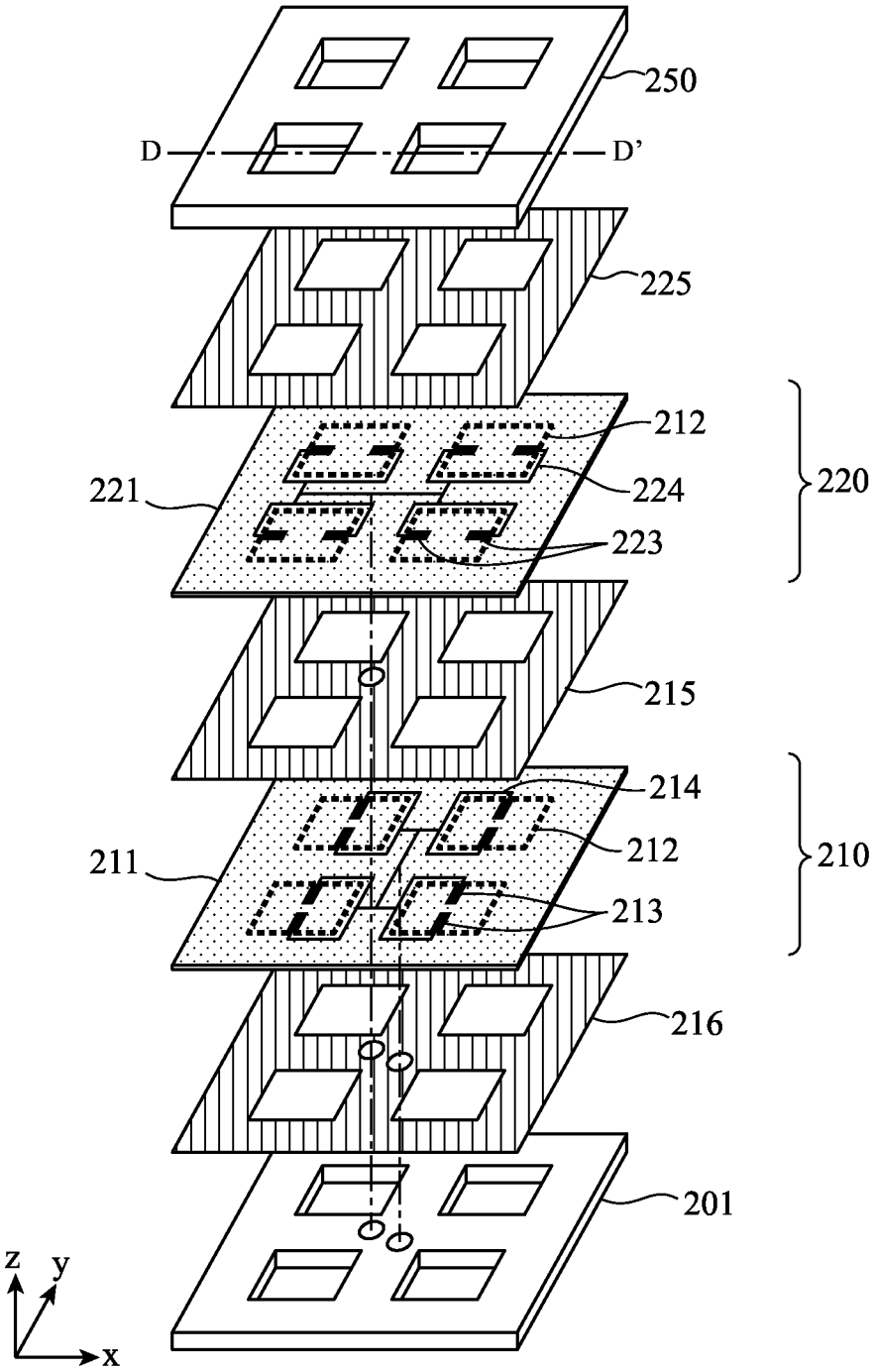
FIG. 18 is an exploded perspective view showing a configuration of a conventional four-element array antenna.

In addition, as shown in FIG. 16, the first power feeding probes 117*a* and 117*b* may be disposed on the ground layer 110*c* and connected to the first transmission lines 118*a* and 118*b* via through-holes 112.

Similarly, the second power feeding probes 127*a* and 127*b* may be disposed on the ground layer 120*c* and connected to the second transmission lines 128*a* and 128*b* via the through-holes 112.

Note that free combinations of the embodiments, modification of any components in the embodiments, or omission of any components in the embodiments of the present invention is possible within the scope of the invention.

INDUSTRIAL APPLICABILITY

The antenna device according to the present invention includes the first matching element composed of the conductor above the first excitation circuit to thereby improve the reflection characteristic even if the cavity is reduced in size, and therefore, it is suitably used for satellite communication, terrestrial radio communication, and the like.

DESCRIPTION OF REFERENCE NUMERALS and SIGNS

1, 101 First cavity parts
10, 110 First excitation circuits
110*a* Third excitation circuit
110*b* Fourth excitation circuit
11, 21, 111, 121 Dielectric substrates
12, 19*a*, 19*b*, 42, 112, 142, 119*a*, 119*b* Through-holes
13, 17, 17*a*, 17*b*, 117, 117*a*, 117*b* First power feeding probes
14, 18, 18*a*, 18*b*, 118, 118*a*, 118*b* First transmission lines
15, 16, 25, 43, 44, 110*c*, 115, 116, 120*c*, 125, 143, 144 Ground layers
20, 120 Second excitation circuits
120*a* Fifth excitation circuit
120*b* Sixth excitation circuit
27, 27*a*, 27*b*, 127, 127*a*, 127*b* Second power feeding probes
28, 28*a*, 28*b*, 128, 128*a*, 128*b* Second transmission lines
30, 130 Second cavity parts (Radiation parts and Lower radiation parts)
40, 140 Matching element sections
41 Dielectric substrate (dielectric substrate for a matching element)
45, 47, 147 Matching elements (first matching elements)
46, 146 Matching elements (second matching elements)
50, 150 Third cavity parts (Radiation part and Upper radiation part).

The invention claimed is:

1. An antenna device comprising:
a cavity composed of a metal conductor having an opening closed in a bottom;
a first excitation circuit superposed and disposed on an upper surface of the cavity, including inside thereof a first power feeding probe and a first transmission line that feeds electric power to the first power feeding probe, and radiating a radio wave of a first polarized wave; and
a radiator superposed and disposed on an upper surface of the first excitation circuit, and composed of a metal conductor having an open hole,
the antenna device further comprising a first matching element composed of a conductor above the first excitation circuit; and between the first excitation circuit and the radiator, a second excitation circuit including inside thereof a second power feeding probe and a second transmission line that feeds electric power to the second power feeding probe, and radiating a radio wave of a second polarized wave orthogonal to the first polarized wave.

2. The antenna device according to claim 1, wherein
the first matching element has a characteristic of matching a polarized wave excited by the first excitation circuit, and transmitting a polarized wave excited by the second exciting circuit, and
the antenna device further includes, above the second excitation circuit, a second matching element matching a polarized wave excited by the second excitation circuit, and transmitting the polarized wave excited by the first excitation circuit.

3. The antenna device according to claim 2, wherein a height from the first excitation circuit to the first matching element and a height from the second excitation circuit to the second matching element are equal or substantially equal.

4. The antenna device according to claim 2, wherein
the first matching element is a slit parallel to the polarized wave excited by the first excitation circuit, and
the second matching element is a slit parallel to the polarized wave excited by the second excitation circuit.

5. The antenna device according to claim 2, wherein
the radiator is divided into a lower radiator and an upper radiator,
a dielectric substrate for a matching element is inserted between the lower radiator and the upper radiator,
the second matching element is formed on an upper surface of the dielectric substrate for the matching element,
the first matching element is formed on a lower surface of the dielectric substrate for the matching element, and
a sidewall of an open hole of the radiator is formed of a through-hole parallel to a tube axial direction and a copper foil on a surface orthogonal to the tube axial direction.

6. The antenna device according to claim 5, further comprising:
a first vertical power feeding section extending a line from a start point of the first transmission line to an antenna lower part; and
a second vertical power feeding section extending a line from a start point of the second transmission line to the antenna lower part, wherein
the first and second vertical power feeding sections are formed in waveguide structures,
as a back-short section in the waveguide structure,
the antenna device includes an open hole in the lower radiator right above a start point of the first transmission line, and
a copper foil of the dielectric substrate for the matching element is formed as a short-circuit surface of the back-short section, or
the antenna device includes an open hole in the lower radiator right above a start point of the second transmission line, and
the copper foil of the dielectric substrate for the matching element is formed as the short-circuit surface of the back-short section.

7. The antenna device according to claim 5, further comprising:
a first waveguide section communicating from the first excitation circuit to a lower surface of the cavity; and
a second waveguide section communicating from the second excitation circuit to the lower surface of the cavity, wherein the first power feeding probe is configured of a third power feeding probe and a fourth power feeding probe opposed to each other, the second power feeding probe is configured of a fifth power feeding probe and a sixth power feeding probe opposed to each other, the first transmission line is configured of a third transmission line, one end portion of which is connected to the third power feeding probe, and a fourth transmission line, one end portion of which is connected to the fourth power feeding probe, the second transmission line is configured of a fifth transmission line, one end portion of which is connected to the fifth power feeding probe, and a sixth transmission line, one end portion of which is connected to the sixth power feeding probe, other end portions of the third transmission line and the fourth transmission line are connected to opposing parts of the first waveguide section, and phases of signals of the third transmission line and the fourth transmission line are adapted in phases opposite to each other, and other end portions of the fifth transmission line and the sixth transmission line are connected to opposing parts of the second waveguide section, and phases of signals of the fifth transmission line and the sixth transmission line are adapted in phases opposite to each other.

8. The antenna device according to claim 7, wherein the first excitation circuit is divided into two layers of a third excitation circuit and a fourth excitation circuit, the third transmission line is and the third power feeding probe disposed in the third excitation circuit, the fourth transmission line is disposed in the fourth excitation circuit, the second excitation circuit is divided into two layers of a fifth excitation circuit and a sixth excitation circuit, the fifth transmission line and the fifth power feeding probe is disposed in the fifth excitation circuit, and the sixth transmission line is disposed in the sixth excitation circuit.

9. The antenna device according to claim 7, wherein the first excitation circuit is divided into two layers of a third excitation circuit and a fourth excitation circuit, the third transmission line is disposed in the third excitation circuit, the fourth transmission line is disposed in the fourth excitation circuit, the third power feeding probe and the fourth power feeding probe are disposed between the third excitation circuit and the fourth excitation circuit, and the second excitation circuit is divided into two layers of a fifth excitation circuit and a sixth excitation circuit, the fifth transmission line a is disposed in the fifth excitation circuit, and the sixth transmission line is disposed in the sixth excitation circuit, the fifth power feeding probe and the sixth power feeding probe are disposed between the fifth excitation circuit and the sixth excitation circuit.

10. The antenna device according to claim 1, wherein the first power feeding probe is configured of two probes directly opposed to each other, the probes being fed with electric power in phases opposite to each other or at a phase difference close to the opposite phases, and the second power feeding probe is configured of two probes directly opposed to each other, the probes being fed with electric power in phases opposite to each other or at a phase difference close to the opposite phases.

11. An antenna device comprising:

a cavity composed of a metal conductor having an opening closed in a bottom;

a first excitation circuit superposed and disposed on an upper surface of the cavity, including inside thereof a first power feeding probe and a first transmission line that feeds electric power to the first power feeding probe, and radiating a radio wave of a first polarized wave;

a radiator superposed and disposed on an upper surface of the first excitation circuit, and composed of a metal conductor having an open hole; and a first matching element composed of a conductor above the first excitation circuit, wherein an opening diameter of the cavity is equal to or smaller than a cutoff in a basic mode of a waveguide at a lower limit frequency.

12. An array antenna device comprising:

a cavity composed of a metal conductor having a plurality of arrayed openings closed in bottoms;

a first excitation circuit superposed and disposed on an upper surface of the cavity, and including inside thereof a plurality of arrayed first power feeding probes and a first transmission line that feeds electric power to the first power feeding probes, and radiating a radio wave of a first polarized wave;

a radiator superposed and disposed on an upper surface of the first excitation circuit and composed of a metal conductor having a plurality of arrayed open holes;

a plurality of arrayed first matching elements composed of a conductor above the first excitation circuit; and between the first excitation circuit and the radiator, a second excitation circuit including inside thereof a plurality of arrayed second power feeding probes, and a second transmission line that feeds electric power to the second power feeding probes, and radiating a radio wave of a second polarized wave orthogonal to the first polarized wave.

13. The array antenna device according to claim 12, wherein the first matching element has a characteristic of matching a polarized wave excited by the first excitation circuit and transmitting a polarized wave excited by the second exciting circuit, and the antenna device further includes, above the second excitation circuit, a plurality of arrayed second matching elements matching a polarized wave excited by the second excitation circuit and transmitting a polarized wave excited by the first excitation circuit.

14. The array antenna device according to claim 13, wherein a height from the first excitation circuit to the first matching elements and a height from the second excitation circuit to the second matching elements are equal or substantially equal.

15. The array antenna device according to claim 13, wherein the first matching element is a slit parallel to the polarized wave excited by the first excitation circuit, and the second matching element is a slit parallel to the polarized wave excited by the second excitation circuit.

16. The array antenna device according to claim 13, wherein the radiator is divided into a lower radiator and an upper radiator, a dielectric substrate for a matching element is inserted between the lower radiator and the upper radiator, the second matching element is formed on an upper surface of the dielectric substrate for the matching element, the first matching element is formed on a lower surface of the dielectric substrate for the matching element, and a sidewall of an open hole of the radiator is formed of a through-hole parallel to a tube axial direction and a copper foil on a surface orthogonal to the tube axial direction.

17. The array antenna device according to claim 16, further comprising:

a first waveguide section communicating from the first excitation circuit to a lower surface of the cavity; and a second waveguide section communicating from the second excitation circuit to the lower surface of the cavity, wherein each of the first power feeding probes is configured of a third power feeding probe and a fourth power feeding probe opposed to each other, each of the second power feeding probes is configured of a fifth power feeding probe and a sixth power feeding probe opposed to each other, the first transmission line is configured of a third transmission line, one end portion of which branches to be connected to respective third power feeding probes, and a fourth transmission line, one end portion of which branches to be connected to respective fourth power feeding probes, the second transmission line is configured of a fifth transmission line, one end portion of which branches to be connected to respective fifth power feeding probes, and a sixth transmission line, one end portion of which branches to be connected to respective sixth power feeding probes, other end portions of the third transmission line and the fourth transmission line are connected to opposing parts of the first waveguide section, and phases of signals of the third transmission line and the fourth transmission line are adapted in phases opposite to each other, and other end portions of the fifth transmission line and the sixth transmission line are connected to opposing parts of the second waveguide section, and phases of signals of the fifth transmission line and the sixth transmission line are adapted in phases opposite to each other.

18. The array antenna device according to claim 17, wherein a phase characteristic with respect to a frequency of the third transmission line from the first waveguide section to any of the third power feeding probes, and a phase characteristic with respect to a frequency of the fourth transmission line from the first waveguide section to the fourth power feeding probe opposite thereto has an equal characteristic, and a phase characteristic with respect to a frequency of the fifth transmission line from the second waveguide section to any of the fifth power feeding probes, and a phase characteristic with respect to a frequency of the sixth transmission line from the second waveguide section to the sixth power feeding probe opposite thereto has an equal characteristic.

19. The array antenna device according to claim 17, wherein the first excitation circuit is divided into two layers of a third excitation circuit and a fourth excitation circuit, the third transmission line and each of the third power feeding probes is disposed in the third excitation circuit, the fourth transmission line and each of the fourth power feeding probes is disposed in the fourth excitation circuit, the second excitation circuit is divided into two layers of a fifth excitation circuit and a sixth excitation circuit, the fifth transmission line and each of the fifth power feeding probes is disposed in the fifth excitation circuit, and the sixth transmission line and each of the sixth power feeding probes is disposed in the sixth excitation circuit.

20. The array antenna device according to claim 17, wherein the first excitation circuit is divided into two layers of a third excitation circuit and a fourth excitation circuit, the third transmission line is disposed in the third excitation circuit, the fourth transmission line is disposed in the fourth excitation circuit, and each of the third power feeding probes and each of the fourth power feeding probes are disposed between the third excitation circuit and the fourth excitation circuit, and the second excitation circuit is divided into two layers of a fifth excitation circuit and a sixth excitation circuit, the fifth transmission line is disposed in the fifth excitation circuit, and the sixth transmission line is disposed in the sixth excitation circuit, each of the third power feeding probes and each of the fourth power feeding probes are disposed between the third excitation circuit and the fourth excitation circuit, and each of the fifth power feeding probes and each of the sixth power feeding probes are disposed between the fifth excitation circuit and the sixth excitation circuit.

* * * * *